US008833440B1

(12) United States Patent
Dicksinson

(10) Patent No.: US 8,833,440 B1
(45) Date of Patent: Sep. 16, 2014

(54) HIGH-TEMPERATURE HEAT, STEAM AND HOT-FLUID VISCOUS HYDROCARBON PRODUCTION AND PUMPING TOOL

(71) Applicant: Douglas Ray Dicksinson, Houston, TX (US)

(72) Inventor: Douglas Ray Dicksinson, Houston, TX (US)

( * ) Notice: Subject to any disclaimer, the term of this patent is extended or adjusted under 35 U.S.C. 154(b) by 0 days.

(21) Appl. No.: 14/080,690

(22) Filed: Nov. 14, 2013

(51) Int. Cl.
*E21B 36/00* (2006.01)
*E21B 43/24* (2006.01)

(52) U.S. Cl.
CPC ..... *E21B 43/24* (2013.01)
USPC ..... 166/61; 166/303; 165/163; 165/184; 392/302; 392/303

(58) Field of Classification Search
USPC ..... 166/272.1, 272.3, 302, 303, 57, 60, 61, 166/62, 65.1; 165/163, 54, 184, 156; 392/302, 303, 304, 306
See application file for complete search history.

(56) References Cited

U.S. PATENT DOCUMENTS 1,852,490 A * 4/1932 Sullivan ..... 165/160
2,066,480 A * 1/1937 McKerrall ..... 165/92
2,276,401 A * 3/1942 Joslyn ..... 166/56
2,456,775 A * 12/1948 Fausek et al. ..... 165/141
2,911,047 A * 11/1959 Henderson ..... 166/61
3,062,289 A * 11/1962 Eades ..... 166/61
3,617,699 A * 11/1971 Othmer ..... 392/469
3,643,733 A * 2/1972 Hall et al. ..... 165/81
3,706,872 A * 12/1972 Trabilcy ..... 392/469
4,280,045 A * 7/1981 Blackmore ..... 219/540
4,366,356 A * 12/1982 Ando ..... 219/629
4,480,172 A * 10/1984 Ciciliot et al. ..... 392/396
4,995,450 A * 2/1991 Geppelt et al. ..... 165/104.21
6,588,500 B2 * 7/2003 Lewis ..... 166/61
7,756,404 B2 * 7/2010 Schubert et al. ..... 392/478
2006/0131027 A1 * 6/2006 Chiesa et al. ..... 166/367
2007/0029067 A1 * 2/2007 Kidwell et al. ..... 165/45
2008/0017361 A1 * 1/2008 Van Decker et al. ..... 165/156
2009/0250200 A1 * 10/2009 Kidwell et al. ..... 165/154
2011/0017449 A1 * 1/2011 Berruti ..... 166/272.3
2013/0199786 A1 * 8/2013 McConaghy et al. ..... 166/302

* cited by examiner

*Primary Examiner* — Blake Michener
(74) *Attorney, Agent, or Firm* — Harrison Law Office, PC

(57) ABSTRACT

Apparatus and methodology for self-generating high-temperature water and superheated steam for recovering embedded heavy-viscosity hydrocarbons from subterranean rock, shale, bitumen, sand formations and enabling continuous flow of released heavy-viscosity hydrocarbons using four successive spiral trough-like flowpaths, and optionally comprising an internal elongated pump member. Another embodiment promotes continuous flow of heavy-viscosity hydrocarbons through surface pipelines to tanks, railway tankcars, ships, refineries. A plurality of high-temperature, sheathed insertion heaters sustains constant high temperature to assure continuous flow of such hydrocarbons.

19 Claims, 14 Drawing Sheets

HIGH-TEMPERATURE HEAT, STEAM AND HOT-FLUID VISCOUS HYDROCARBON PRODUCTION AND PUMPING TOOL

RELATED APPLICATIONS

This application claims priority based upon U.S. Provisional Application Ser. No. 61/726,013 filed Nov. 14, 2012; U.S. Provisional Application Ser. No. 61/865,509 filed Aug. 13, 2013; U.S. Provisional Application Ser. No. 61/875,260 filed Sep. 9, 2013; and U.S. Provisional Application Ser. No. 61/885,029 filed Oct. 1, 2013. The disclosures recited in these provisional applications are incorporated herein by reference.

FIELD OF THE INVENTION

The present invention relates to an apparatus for injecting high-temperature heat, steam and hot fluid through casing wall bore holes into hydrocarbons being urged to the well surface via production tubing, and more particularly, relates to a tool for using self-generated high-temperature heat, steam and hot fluid to enable high-viscosity hydrocarbons to be released from subsurface shale, sand, and rock formations into an adjacent downhole well, and then being pumped upwards from any subsurface level within the well via production tubing to the surface thereof; and for using such self-generated high-temperature heat, steam and hot fluid to enable high-viscosity hydrocarbons to sustain adequate fluidity while being transported in surface or even above-surface pipelines for loading otherwise high-viscosity hydrocarbons onto ships, oil tankers, refineries, tank trucks, and the like.

BACKGROUND OF THE INVENTION

There continues to be a plethora of challenges associated with effectively and economically using high-heat temperature steady-state steam to enable heavy viscosity hydrocarbons or minerals to be extracted and produced from subsurface crude oil-bearing rock formations, wherein such hydrocarbons are released from being embedded within subsurface reservoirs. As will become evident to those conversant in the art, embodiments of the downhole tool taught by the present invention are designed to be surprisingly useful for recovering viscous hydrocarbons downhole in areas or locations fraught with Bitumen, heavy viscosity oil, tar-type crude oil, and the like.

It will become clear that embodiments of the instant downhole tool will produce and sustain superheated steam temperatures, when heating solvent solutions, or heating water and other fluids—that are injected into the well at its upper ground-level surface. When the hot fluids and high temperature steam levels are reached in the heating area, the superheated steam and/or hot fluids pass through rock fissures laterally and/or vertically. Radial injection thereof passes through a plurality of well bores within the casing and then passes into the rock and other implicated outer formations, in order to release encapsulated heavy, viscous crude oil, tar-type crude and other minerals. It will be appreciated that this methodology allows heavy, viscous crude and other minerals to seep into the area of the well from which the crude oil and/or other minerals may be pumped upwardly to the well surface.

It is well known that heavy, viscous oil and other hydrocarbons will not flow to the surface of a well bore in sufficient quantity to be economically viable without being assisted or, indeed, without being driven, by heated steam, solvent, or other hot fluids. Accordingly, superheated steam and other hot fluids contemplated hereunder are transferred through the annulus formed between production pipe and surrounding outermost casing. A plurality of high temperature insertion heaters implemented in preferred embodiments of the present invention should preferably be located in the walls of the production pipe through which such viscous hydrocarbons and the like are pumped upwards to the well surface. It will be appreciated that, when water and other fluids pass through the annulus where the plurality of heating units are emplaced, superheated steam and hot fluids are produced and transferred through the well bores into the rock and other formations, simultaneously heating and moving heavy, viscous hydrocarbons to the well holes. Embodiments of the present invention also envision an optional high temperature oil pump design that could be included in the downhole high-temperature steam production and hydrocarbon recovery methodology hereof.

It is anticipated that embodiments of the instant high-temperature heat, superheated steam and hot-fluid tool will significantly improve upon the established downhole hydrocarbon recovery methodology typically referenced as "Steam Assisted Gravity Drainage." For instance, if an embodiment hereof were installed in a plurality of pairs, disposed either vertically or horizontally as appropriate, with its embedded plurality of high-temperature heaters being preferably disposed proximal to targeted reservoir, the generated continuous stream of superheated steam and high-temperature fluid would be communicated to the heavy-viscosity rock, shell, bitumen, sand and the like for expediting extraction and outward flow thereof. Indeed it is contemplated that the instant methodology will also significantly enhance another established technique for extraction of entrenched viscous hydrocarbons: "Cyclic Steam Stimulation."

Similarly, it will also be appreciated that heavy, viscous oil and other hydrocarbons will not flow through pipelines on or above the surface in sufficient quantity to be economically viable without being assisted or, indeed, without being driven, by heated steam, solvent, or other hot fluids. Accordingly, superheated steam and other hot fluids contemplated hereunder are transferred through the annulus formed between pipelines and surrounding protective casing. A plurality of high temperature insertion heaters implemented in preferred embodiments of the present invention should preferably be located in the pipeline walls through which such viscous hydrocarbons and the like are pumped substantially horizontally to storage tanks, tankcars, ships, and other suitable surface hydrocarbon storage facilities. It will be appreciated that, when water and other fluids pass through the annulus where the plurality of heating units are emplaced, superheated steam and hot fluids are produced and transfer heat through the pipeline wall thereby heating and facilitating flow of heavy, viscous hydrocarbons to the designated hydrocarbon storage destination. Embodiments of the present invention also envision an optional high temperature oil pump design that could be included in the high-temperature steam production and hydrocarbon recovery methodology hereof.

SUMMARY OF THE INVENTION

The present invention provides apparatus and concomitant methodology for injecting steady-state high-temperature steam downhole in order to effectuate fracturing of subsurface rock, shell, sand formations so that heavy, viscous hydrocarbons may be released therefrom and then be caused to flow continuously upwardly to the well surface. High heat is preferably provided by a plurality of metal sheathed heating members or heating elements configured and swaged in situ preferably in an insulated Inconel outside sheath. For instance, in an Inconel 600 sheath, there would be two to six separate metal sheathed heating members or elements arranged in a parallel configuration therewithin. Embodiments of the present invention preferably opt to engender continuous constant temperatures of about 1,000° F. It will be understood that the flow rate of pressurized water, solvent solutions or any other suitable fluids in conjunction with implicated superheated steam would be functionally related to and manifest by efficient heat dissipation and dissemination heretofore unknown in the art. It will be appreciated by practitioners skilled in the art that water fluid flow rate may be reduced in order to control hydrocarbon flow temperature.

As will become clear to those conversant in the art, embodiments of the present invention are structured with a spiral configuration comprising a plurality of spiral trough-like flowpaths for communicating superheated steam and hot-fluids throughout a downhole wellbore for transferring its high-heat through a plurality of holes in the well casing located proximal to formations characterized by high-viscosity hydrocarbons contained within rock, shell, bitumen, sand, and the like. A constant infusion of such high-heat urges such encapsulated or otherwise entrapped viscous hydrocarbons to be released therefrom and be caused to flow into and through the same plurality of adjacent or proximal wellbore holes and then be further urged toward the well surface under the influence of the available pumping forces. It will be understood that it is a feature and advantage of embodiments hereof that the influence and effect of the inherent self-generated high-heat and superheated steam is sustained throughout the production tubing by the series of heating elements enmeshed into the walls of the plurality of circumscribing helical flowpaths which are optimally situated adjacent the exterior wall of the production pipe through which the viscous hydrocarbon is flowing toward the well surface. Indeed, placement of such novel plurality of helical flowpaths disposed circumferentially of the enclosed production string can be emplaced at virtually any level of such string or, alternatively, in front of or below the oil well packer or the like.

It will be seen that plurality of streams of high-temperature fluid and superheated steam traveling through a like plurality of spiral flowpaths with a plurality of heating elements enmeshed into the pipe walls comprising such flowpaths. These flowpath pipe walls function as heat sinks for transferring high-heat into implicated water and other fluids passing therethrough.

Another embodiment of the instant tool adapted for expeditiously urging continuous flow of heavy-viscosity hydrocarbon comprises a second helical flowpath—similarly having a plurality of suitably configured and temperature-controlled heater members inserted into the external wall of the flowpath pipe—but, instead of affording a spiral flowpath for self-generated high-temperature fluid and superheated steam, this second spiral flowpath accommodates continuous flow of otherwise heavy-viscosity hydrocarbons by emulating pumping action thereof. Thus, a downhole embodiment of this production and pumping tool essentially provides a secondary or auxiliary pump that functions as a supplemental or reinforcing pumping capability for urging continuous upward flow of such recovered hydrocarbon within production tubing.

The present invention also contemplates apparatus and concomitant methodology for continuously providing steady-state high-temperature steam to a preferably spirally-circumscribed substantially horizontally disposed pipeline in order to effectuate continuous flow of heavy, viscous hydrocarbons, thereby caused to flow continuously throughout the pipeline from one storage facility or vehicle or the like to another storage facility or storage vehicle or the like, with both such storage facilities or storage vehicles or the like being disposed on or proximal to the ground surface. High heat is preferably provided by a plurality of metal sheathed heater elements configured and swaged in situ preferably in an Inconel outer sheath. For instance, in an Inconel 600 outer sheath, there are two to six separate metal sheathed heater elements arranged in a parallel configuration therewithin. But, it should be clearly understood that the teachings hereof are not limited to any particular quantity or combination of heating elements or heater members, so long as the contemplated high-heating temperature prerequisite is satisfied. This surface-oriented embodiment of the present invention may also comprise a secondary pumping capacity, as would be an option for the comparable downhole-oriented embodiment, wherein it functions as a supplemental or auxiliary reinforcing pumping capability for urging continuous substantially horizontal flow of such hydrocarbon, by being preferably disposed within tubing transferring the hydrocarbons from one storage facility or storage vehicle or the like to another.

It is an object of the present invention to sustain high temperature of downwardly injected admixture of saturated water and superheated steam as a function of hydrocarbon viscosity in order to effectively facilitate upward flow thereof by creating fissures in subsurface rock formations by fracking and thereby enable release of viscous hydrocarbons embedded therewithin.

It is another object of the present invention to promote flow of released subsurface viscous hydrocarbons from being embedded in downhole rock, shell, sand and gravel formations by continuously impressing high-temperature, high-pressure superheated steam and the like thereupon.

It is another object of the present invention to promote upward continuous flow of inherently viscous hydrocarbons from downhole to the well surface through production tubing by continuously impressing high-temperature, high-pressure superheated steam and the like thereupon.

It is yet another object of the present invention to promote substantially horizontal continuous flow of inherently viscous hydrocarbons through pipeline located on or above the surface by continuously impressing high-temperature, high-pressure superheated steam and the like thereupon.

These and other objects of the present invention will become apparent from the following disclosure and accompanying drawings in which like numerals depict like components.

DETAILED DESCRIPTION

Reference is made herein to FIGS. 1-16 depicting various views of the preferred downhole embodiments of the instant high-temperature heat, steam and hot fluid pump and production tool contemplated by the present invention. It should be clearly understood that, even though illustrative embodiments included in FIGS. 1A-C, 2-8 and FIGS. 9A-E, 10-16 pertain primarily to downhole fracking and like contexts, there are a plethora of other embodiments of the present invention that are especially conducive to and advantageous for enabling continuous fluidized-flow of hydrocarbon liquids—notwithstanding such hydrocarbons otherwise inherently having high-viscosity which may be worsened under environmental conditions of extremely cold temperatures or like adverse conditions—through pipelines disposed upon, above or below the earth's surface. Indeed, as will become clear to those skilled in the art, the preferred embodiments depicted in FIGS. 17, 17A-C, and 18-20 of the instant high-temperature heat, steam and hot fluid tool contemplated by the present invention adapted for substantially horizontally-disposed pipeline applications that preferably continuously transport viscous hydrocarbons from one storage facility or storage vehicle to another storage facility or storage vehicle via such pipelines but under the influence of high-temperature heat and superheated steam as will herein be elucidated.

Figure 1A:
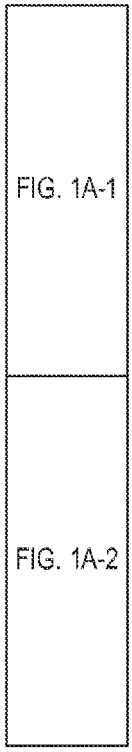
FIG. 1A depicts a front view of a preferred embodiment of the present invention, subdivided into a top portion 1A-1 thereof and a bottom portion 1A-2 thereof.
Figures 1, 1A:
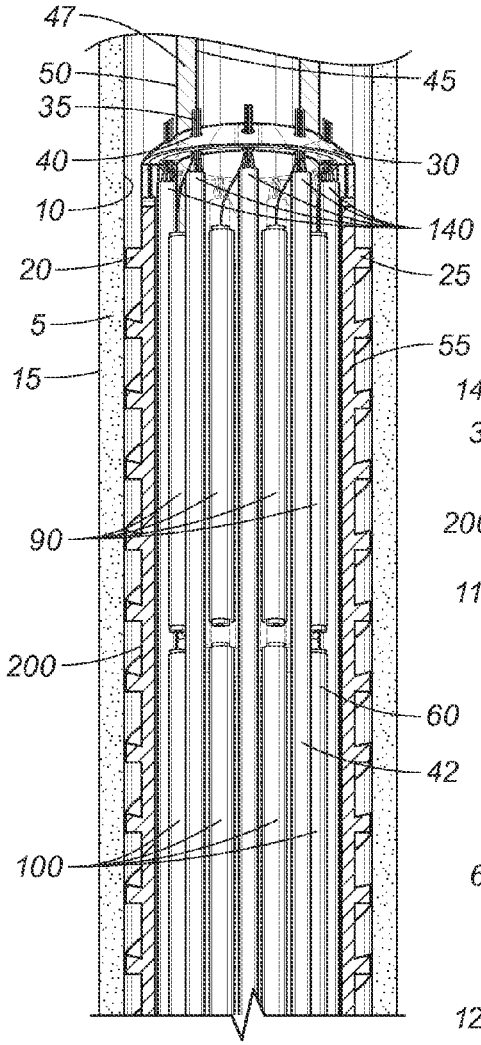
Figures 1, 1A, 2:
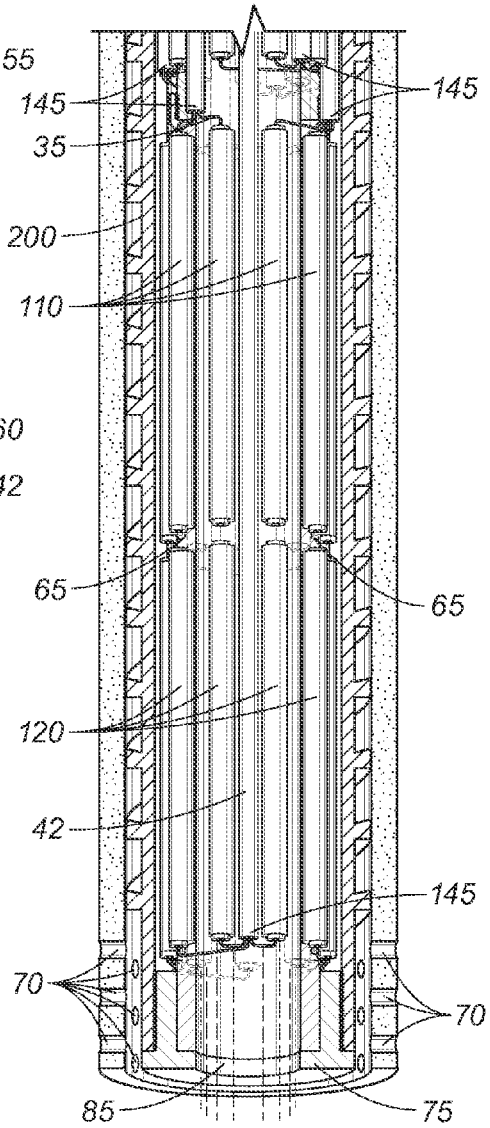
FIG. 2 depicts an upper cross-sectional view of the embodiment of the present invention depicted in FIGS. 1A-C, wherein the section is along line 2-2.
Figure 1B:
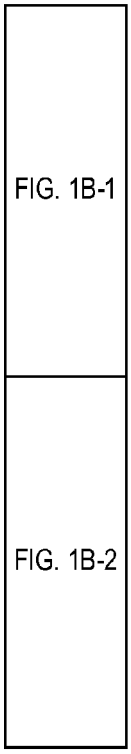
FIG. 1B depicts a simplified view of the front view depicted in FIG. 1A identifying each of the cross-sectional views depicted in FIGS. 2-8, and subdivided into a top portion 1B-1 thereof and a bottom portion 1B-2 thereof.
Figures 1, 1B:
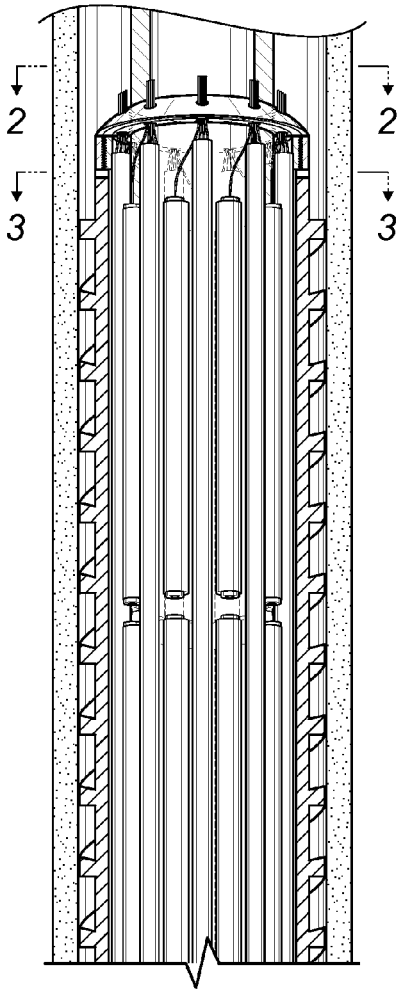
Figures 1, 1B, 2:
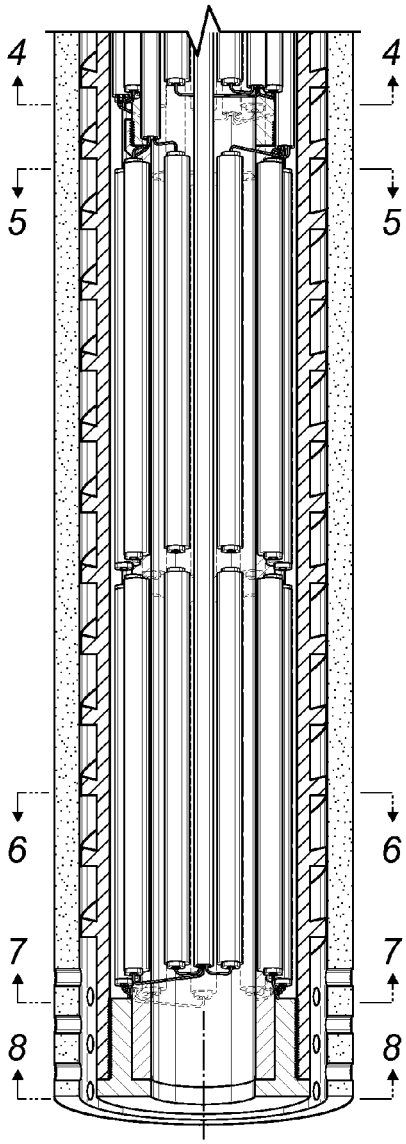
Figure 1C:
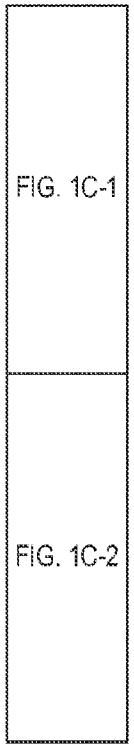
FIG. 1C depicts a perspective view of the embodiment depicted in FIGS. 1A-B, subdivided into a top portion 1C-1 thereof and a bottom portion 1C-2 thereof.
Figures 1, 1C:
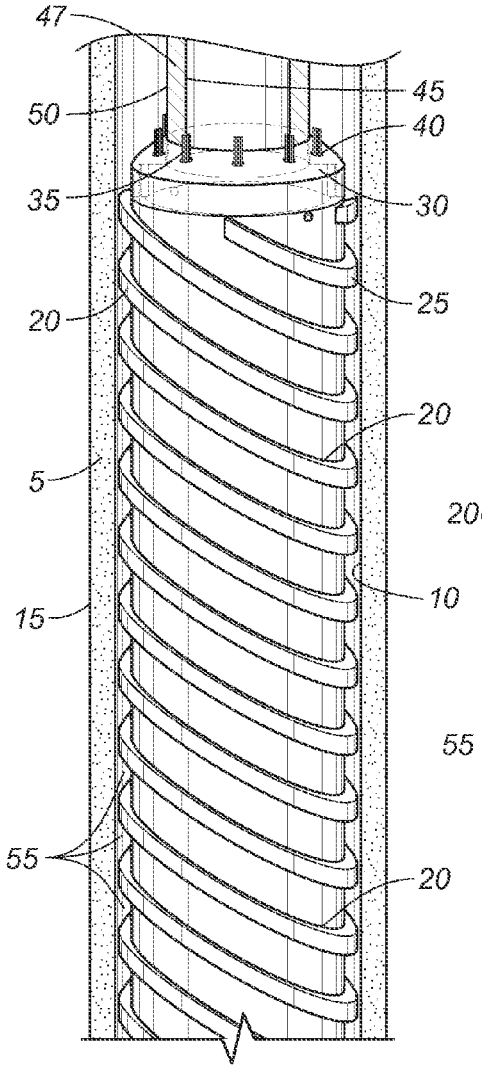
Figures 1, 1C, 2:
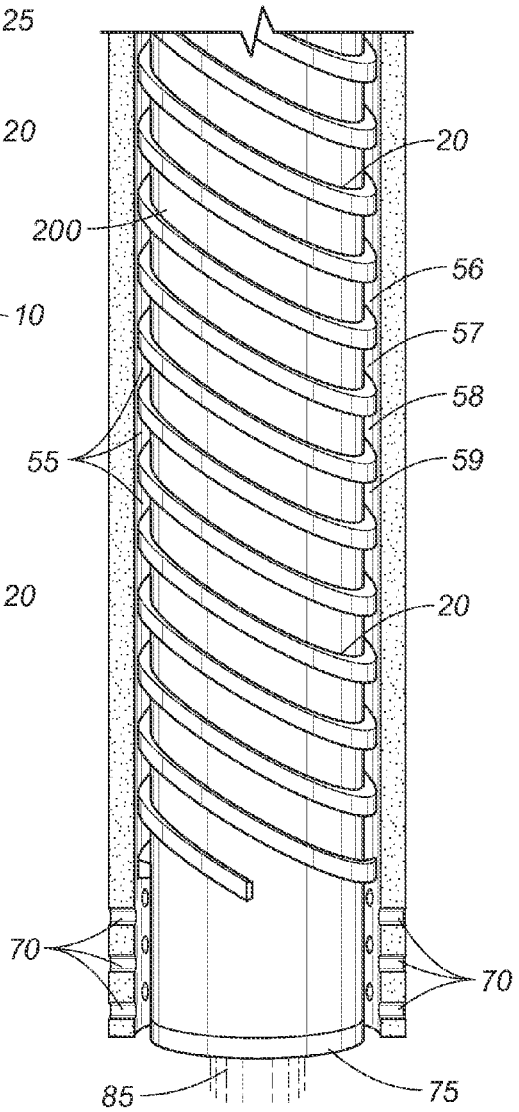
Figure 4:
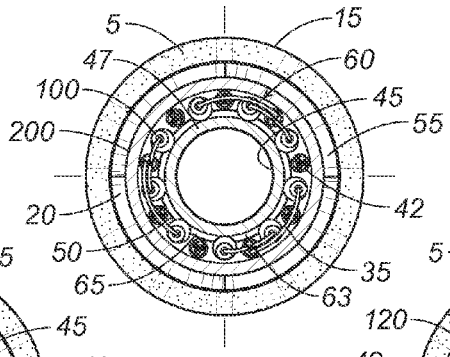
FIG. 4 depicts a cross-sectional view of the embodiment depicted in FIGS. 1A-C, wherein the section is along line 4-4.
Figure 2:
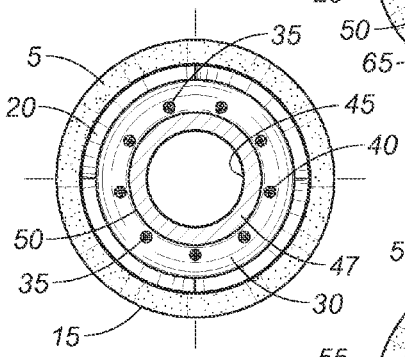
Figure 7:
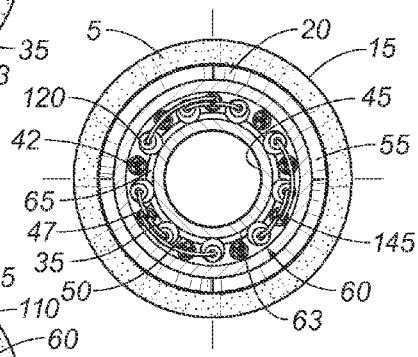
FIG. 7 depicts a cross-sectional view of the embodiment depicted in FIGS. 1A-C, wherein the section is along line 7-7.
Figure 5:
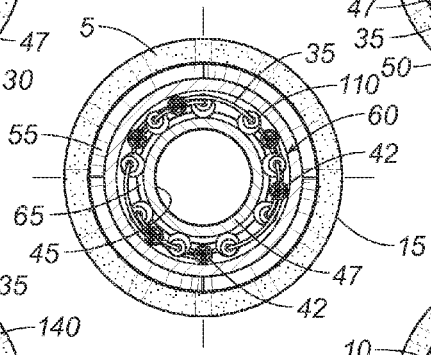
FIG. 5 depicts a cross-sectional view of the embodiment depicted in FIGS. 1A-C, wherein the section is along line 5-5.
Figure 3:
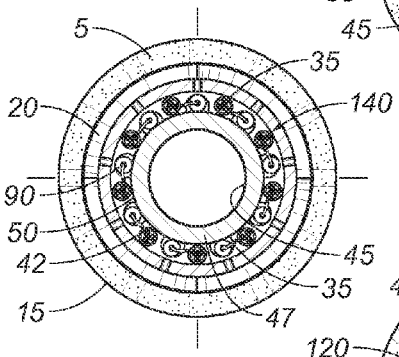
FIG. 3 depicts a cross-sectional view of the embodiment depicted in FIGS. 1A-C, wherein the section is along line 3-3.
Figure 8:
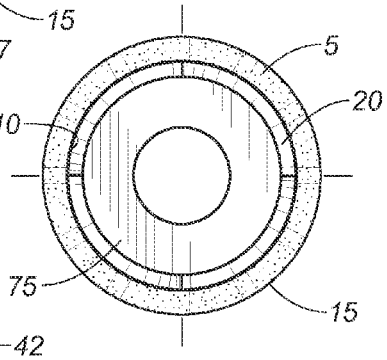
FIG. 8 depicts a lower cross-sectional view of the embodiment depicted in FIGS. 1A-C, wherein the section is along line 8-8.
Figure 6:
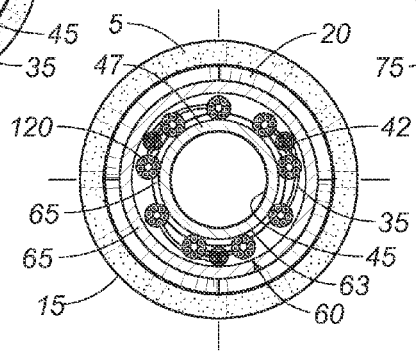
FIG. 6 depicts a cross-sectional view of the embodiment depicted in FIGS. 1A-C, wherein the section is along line 6-6.

More particularly, FIGS. 1A-B each depict a frontal view of the preferred embodiment of the instant high-temperature heat, superheated steam and hot fluid production tool disposed downhole at a well site. FIG. 1A is a front view with numerals assigned to the various components comprising the preferred embodiment of the present invention. FIG. 1B corresponds to a simplified, unnumbered version of the front view depicted in FIG. 1A, but also depicting the lines upon which each of the cross-sectional views in FIGS. 3-8 are taken. FIG. 1C depicts a perspective view of the embodiment depicted in FIGS. 1A-B, displaying the plurality of spiral trough extended surface area flowpath of the superheated steam and hot fluid that sustain continuous contact of the high-temperature heat being transferred from the superheated steam and hot fluid flowing within this plurality of spiral trough extended surfaces 55 to the axially and centrally upwardly flowing hydrocarbon production stream through production pipe 47 having interior cylindrical surface 45 and outer cylindrical surface 50. FIG. 2 depicts a top view of the embodiment depicted in FIGS. 1A-B.

The present invention contemplates a steam tool that inherently affords an advanced, especially advantageous panoply of properties that engender sufficiently constant high temperatures throughout pipelines on the basis of superheated steam production and concomitant heretofore unknown efficient recovery and/or continuous flow therethrough especially of viscous oil and other viscous hydrocarbons. For instance, it will become clear to those conversant in the downhole and fracturing arts that such panoply of advanced qualities devolve to a unique methodology for sustaining continuous, constant high-heat, high temperature steam, and/or hot solvent solutions or hot fluid thermal properties that are produced and sustained proximal to heavy viscous oil and other hydrocarbons, and even extra-heavy, highly viscous hydrocarbons or Bitumen coal reservoirs or the like.

It will become evident to those skilled in the art that embodiments of the methodology enabled hereunder, due to the astonishing attributes of embodiments of the instant superheated steam-driven production tool, will effectuate a heretofore unattainable reduction of transfer time of viscous oil and other viscous hydrocarbons from being entrapped in the subterranean fissures and associated reservoirs, and the like, and being continuously and efficiently brought to the well surface. Similarly, it will also be appreciated that such surprisingly efficient and continuous transfer of high-viscosity hydrocarbons and the like is routinely sustained through pipelines disposed at various locations at, near or remote of well sites due to the astonishing attributes of embodiments of the instant superheated steam-driven production tool. The structure and functionality of embodiments of the instant tool and consequent urged continuous upward fluid-flow of viscous hydrocarbons and implicated extraction methodology for manifesting sustained downhole high-temperature steam production and efficient forced flow of formerly entrapped viscous hydrocarbons to the well surface will hereinafter be elucidated.

Focusing again on downhole applications, embodiments of the instant steam tool and concomitant methodology produce and control the high-heat, superheated steam, and/or fluid high temperatures to plurality of vertical and/or horizontal well holes 70. It will be understood that these well holes should optimally be situated at an elevation proximal to Bitumen and/or other viscous hydrocarbon reservoirs. Among other things, the functions of such embodiments of the instant downhole production tool are to increase the quantity of the daily fluid flow rate of viscous oil and other viscous hydrocarbons brought by being lifted to the well surface more efficiently than has been heretofore considered to be practicable or even possible. It will become evident to those skilled in the art that embodiments of the present invention, on the basis of having its flowpath disposed in spiral configuration that engulfs the centralized axial area of the production string—that, of course, communicates viscous oil and other viscous hydrocarbons to the well surface—while this spiral configuration, optimally emplaced in a trough disposition within the annulus located between this production tubing and the well casing, acts as high-heat steam and superheated-steam transfer area that enables the plurality of heating units to continue to function normally while heavy viscous hydrocarbons and associated fluids are being heated simultaneously with removal thereof from the wellbore.

Referring now to FIGS. 1A and 1B, there are shown identical frontal views of a preferred embodiment of the present invention which is depicted in situ in a downhole orientation. There is depicted outer casing 5 with its inside wall 10 enclosing four 90° offset flow paths of the hot-fluid and steam chamber as will be hereinafter described. Also shown is outer wall 15 of outer casing 5. Multifunctional fluid and steam flow guide 20 controls hot-fluid and steam downward spiraling movement thereof while simultaneously facilitating heat sink attributes as will be hereinafter elucidated. Channel or trough 25 contained within helical flow guide 20 enables continuous flow of hot-fluid and steam therethrough wherein associated multilateral heat sink 200 absorbs heat from outside of this hot-fluid and steam chamber on one side and transfers heat thereinto using the heat sink's other three sides for dispersing the self-engendered high-heat.

As will be understood by those skilled in the art, multifunctional alignment plate 30 affords stability and alignment of the electrical conduit 42 that passes through the heat chamber 200. This alignment plate also tends to promote alignment of the heat chamber pipe walls while simultaneously sealing off the heating area disposed therethrough. It will be appreciated that the top of alignment plate 30 also functions as the base area of the electrical wiring junction area 145 for powering the plurality of heaters 60 for generating high-temperature preferably superheated steam prerequisite for enabling the continuous upward flow of viscous hydrocarbons contemplated herein. Thus, heater wiring 35 conducts electricity from this wiring junction area to the heater tube or conduit 42 and for delivering electricity for powering plurality of heaters 60. Each of plurality of conduit locks 40 comprises a threaded conduit fastener that secures corresponding plurality of electrical conduit 42 to multifunctional alignment plate 30.

It has been found that at least nine insertion heaters as herein described are prerequisite for each spiral level, 56, 57, 58 and 59, respectively, of plurality of spiral levels 55 to achieve the contemplated heating threshold for producing superheated steam and to sustain continuous production thereof. Heater wiring for each set of three insertion heaters of such nine-heater combination 56, 57, 58 or 59 should preferably be arranged in a delta configuration via three conduits. It should be evident that each such conduit accommodates a delta configuration of three such heaters. Since it will become apparent that embodiments of the present invention are structured preferably with at least four levels of heaters incorporated into corresponding four spiral channels or troughs for flow of high-heat, superheated-steam and high-heat fluids, a total of at least thirty-six insertion heaters preferably power the contemplated steam chamber to generate superheated steam inherent herein. It will be appreciated by those skilled in the art that the plurality of spiral troughs taught hereunder function not only as flow paths for self-generated high-heat, superheated-steam and high-heat fluids, but also function as heat sinks for continuously effectuating efficient heat transfer with adjacent pipeline for transporting hydrocarbons or with subsurface reservoirs in which high-viscosity hydrocarbons have been entrapped.

Indeed, it should be clear that the spiral configuration of each of the plurality of channels 55 tend to maximize high-heat exposure of flowing water in order to promote efficient generation of superheated steam. It has also been found that using a special coating insulates such heat sinks and promotes transfer of heat outward to water, thereby avoiding loss of heat inside to oil and other hydrocarbons. Such coating could be achieved by using reflective paint or the like. It should be evident that the present invention strives to heat only the outside surface of plurality of spiral pipe 55 having water flowing therein in order to maximize generation of superheated steam. It will also be understood that insulation may be invoked to circumscribe outside pipe surface with ceramic wrap or like materials to assure that prerequisite high heat is specifically applied to the water cavity 200 where superheated steam is engendered.

As is well known in the art, production tubing string affords a pathway for oil and other hydrocarbons to be pumped from subsurface formations uphole to the well surface. Accordingly, oil and other hydrocarbons are pumped to the surface within cylindrical interior surface 45 of production tubing string 47 which is, in turn, bounded by exterior surface thereof 50. An important aspect of the present invention is plurality of spiral channels 55 that provides a plurality of guiding pathways 20 preferably configured as plurality of trough structures 25 through which admixed hot fluid and superheated steam are transported through the steam production chamber downhole and then through well bores 70 into subterranean formations fraught with viscous oil and other viscous hydrocarbons.

Referring again collectively to FIGS. 1-8, it will be understood that each of the four spiral troughs 80, 100, 110 and 120 are offset by 90°, wherein a full circular cross-section of 360° is encompassed to promote continuous flow of superheated steam and hot liquid therethrough. Plurality of tubular insertion heaters 60 may be obtained and configured in various lengths, varying from only one foot long to 25 feet or more, and affording many different combinations of heat production attributes and capabilities. For instance, MaxiZone high-temperature insertion heaters manufactured by Chromalox Precision Heat and Control of Pittsburgh, Pa. have been found to afford prerequisite performance for implementation of the embodiments contemplated hereunder. MaxiZone insertion heaters produce continuous sheath temperatures up to 2,000° F. and have been designed to achieve precise, uniform temperatures with a plurality of independently controlled heating zones along the sheath's length. Moreover, radiant heat transfer enables these heaters 60 to be smaller than their corresponding emplacement apertures, which facilitates convenient insertion and removal thereof.

A typical Chromalox MaxiZone heater is constructed with two to six separate metal-sheathed, high-temperature resistance wire heating elements that are arranged and swaged in situ with high-purity magnesium oxide insulation in an Inconel 600 outer sheath. Inconel alloy 600 is a standard engineering material for applications demanding corrosion and high-temperature resistance to temperatures as high as 2,000° F. A preferred embodiment comprises 36 MaxiZone insertion heaters and 4 Chromalox NEMA 12 control panels (4230 Series affording 100-1200 amps and 208-575 volts). Each such insertion heater is capable of generating 14.5 KW; accordingly, it should be evident to practitioners in the art that an apparatus as taught hereunder with 36 heaters generates 522 KW—clearly sufficient heat to produce plentiful superheated steam prerequisite for achieving the constant fluidity-flow contemplated herein. An advantageous feature of embodiments of the present invention is that the well casing 5 functions as a layer of insulation that prevents superheated steam-driven oil and other hydrocarbons from clustering and impeding upward flow thereof as contemplated hereunder.

It will be understood by those conversant in the art that a variety of termination assemblies may be invoked including quick disconnect plugs. In the preferred embodiment, the MaxiZone heater diameter is 0.935 inches having a platen hole size of 1 or 1.25 inches with a minimum heated length per zone of 8 inches and a corresponding maximum heated length of 165 inches.

In FIG. 1A, there is seen plurality of heater support shoulder platforms 65 that provide support to each corresponding heater of plurality of heaters 60. It will be seen that each such heater support shoulder platform 65 is preferably machined into outer pipe wall preferably along with a modicum of weldment disposed upon this shoulder platform for securing and anchoring plurality of heater tubes 60 thereto.

It will be appreciated by those skilled in the art that plurality of outer casing steam and hot fluid ejection port apertures 70 are used to distribute generated steam and hot fluids through the spiral channels 55 and then be transferred through these wellbores 70 and into formation sections fraught with oil or other hydrocarbons—typically found in subterranean formations such as rock, sand, shell, bitumen or a mixture thereof. As depicted in FIGS. 1A-C, at the bottom of wellbore, spacing and platform base cap 75 comprises a threaded pipe plug or the like. It should be evident that this base cap closes and seals off heat chamber and simultaneously functions as a solid spacer for sealing and separating the annular area between outer surface of production tubing 50 and inner surface 10 of outer casing 5 that encloses the heat chamber hereof.

It will also be seen that conventional rotating rod or sucker rod 80 may optionally be invoked to transfer mechanical energy to an oil pump disposed within production tubing string 47 that axially comes into continuous contact with pipeline surfaces 50 through which high heat is transferred via steam and superheated steam and hot fluid passing through the plurality of spiral channels adjacent circumference of downhole production pipe 47 as taught herein. Downhole oil or other viscous hydrocarbons 85 contained within subsurface reservoir is generally depicted at bottom of the wellbore and driven upwardly therethrough as elucidated herein.

Focusing now to the heating aspects of the present invention, it will be seen that the preferred embodiment is configured with at least four heating tube groups or stages 90, 100, 110 and 120. First heating tube group 90 is preferably configured with nine heating tubes as herein described. Similarly, second heating tube group 100 is preferably configured with nine heating tubes akin to the plurality of heating tubes contained in first heating tube group 90. Similarly, third heating tube group 110 is preferably configured with nine heating tubes akin to the plurality of heating tubes contained in each of first heating tube group 90 and second tube group 100. Similarly, fourth heating tube group 120 is preferably configured with nine heating tubes akin to the plurality of heating tubes contained in each of first heating tube group 90, second heating tube group 100, and third heating tube group 110. It should be understood that, while the preferred embodiment of the present invention is illustrated with four stages of nine heating elements, the instant apparatus taught hereunder may optionally be expanded as a function of how the implicated heat and steam-related components are varied, so long as the contemplated upward flow of high-viscosity hydrocarbons and the like is achieved via the driving force manifest by continuous contact with high-temperature hot fluid and steam through the spirally-configured troughs as elucidated herein. It will also be seen that there are depicted nine insulated conduit ends 140 that terminate in a wire connecting junction area atop alignment base plate 30 in the upper portion of the instant embodiment. It further terminates at the different lower stage levels in which each of the heating tubes different stage insulated conduit wiring connection commences 145. The wired ends 140 thereof show where implicated heater wires 35 are fed into the corresponding conduits 42, enabling this plurality of wires to run up atop the stack of elongated heaters.

It will be observed upon lower portion of production tubing depicted in FIGS. 1A-C that there are depicted three different elevations of exit ports 70 corresponding to the lowest level of the downward spiraling of four channels or troughs 55 wherein heat is continuously transferred into fluids in order to create high-temperature steam and hot fluids that flow therethrough into this plurality of exit ports 70 into the wellbore's outer casing 15, and ultimately into the formation's rock, shell, sand, and other attributes. It should be evident that this high-temperature influence upon such formations proximal to the wellbore tend to substantially eliminate flow impediments and thus cause release of oil and other hydrocarbons entrapped therein.

It will be appreciated that an optional high temperature oil well pump could be included in embodiments of the instant methodology for generating and sustaining oil well downhole high-temperature steam production and consequent recovery of oil as contemplated hereunder.

As hereinbefore described, other variations and modifications will, of course, become apparent from a consideration of the structures and techniques hereinbefore described and depicted. The downhole implementation herein described in detail may be used in a hydrocarbon production stream virtually at any level in a well bore. Similar to scenarios such as Canadian oil sands and oil fields fraught with highly viscous hydrocarbons, embodiments of the present invention may be adapted for use to effectively heat and release such hydrocarbons into adjacent production wells in a manner and with efficiency and reliability heretofore unknown. Indeed, the instant high-heat tool has been designed to self-generate and inject superheated steam and high-temperature fluids into a diversity of contemporary high-viscosity hydrocarbon extraction and/or transfer applications. For instance, an alternative embodiment may be similarly if not identically configured for accommodating fluid-flow of ordinarily high-viscosity hydrocarbons in pipelines disposed substantially horizontally and proximal to the surface. A similar embodiment would lend itself to hydrocarbon pipeline applications that must function in extreme cold environments such as in the North Sea that load hydrocarbons onto ships, tankers, and the like.

It should also be understood by those skilled in the art that insertion and like heaters incorporated into embodiments hereof should be capable of generating high temperatures as high as 2,000° F. and even higher if environmental conditions demand. Nevertheless, it will be appreciated that the longevity of such heaters will be substantially increased if high temperatures on the order of 1,000° F. rather than temperatures on the order of 2,000° F. are invoked. It should be evident that such improved longevity, as much as two-to-three times longer anticipated to constitute several years' service life, is attributable to less demands being imposed upon the internal electronic components thereof. As hereinbefore described, the concomitant controllers would be set appropriately to operate to achieve acceptable high temperatures generally in the range of 1,000° F. to 2,000° F.

It will also be appreciated that a feature of other embodiments of the present invention, as depicted in FIGS. 17, 17A-C, and as hereinbefore elucidated, would be to preferably recirculate the water when invoked on the surface to reproduce superheated steam therefrom. This recirculation protocol would, of course, reduce water consumption. After self-generated heat is transferred to flowing viscous hydrocarbons as herein described, steam would heat the to-be recycled water which should preferably be reconstituted to compensate for minor loss of volume. It should be evident that this effectively would tend to extend the length or reach of the steam wherein recycled, already-heated water efficiently generates more superheated steam for sustaining continuous flow of otherwise highly viscous hydrocarbons within pipelines or loading ships, tanks, or refinery surface pipes. Of course, such pipelines transporting high-viscosity hydrocarbons as contemplated hereunder should preferably enclose implicated pathways with sufficient insulation to maximize transfer of heat to the continuously flowing high-viscosity hydrocarbons—thereby benefitting from increased fluidized hydrocarbon pumping capacity while simultaneously minimizing heat loss.

Shifting focus again to downhole applications hereof, another implementation of embodiments hereof would be to incorporate a plurality of instant high-temperature heat, steam and hot-fluid tools in a sequential configuration at various locations downhole. Then, as superheated steam exits a plurality of steam ports and as hot-liquid descends downhole, implicated water would again be heated preferably to the prescribed constant high temperature, in the lower-placed tool of this sequence of tools, thereby assuring steady state flow of superheated steam and high-temperature fluids within the spiral pathways herein described.

Now shifting focus to surface applications of the present invention, it will be readily recognized by those skilled in the art that this profound highly-viscous hydrocarbon continuous flow benefit may also be achieved by appropriately situating a series of such insulated high-heat tools taught hereunder externally and longitudinally along a pipeline so that the pipeline is continuously kept sufficiently heated to overcome any viscosity-based inhibitions and to sustain fluidized hydrocarbons being urged to pass therethrough.

It has been found that applications having outer casing and the like inherently afford sufficient insulation to minimum temperature changes and thus avoid any adverse effects attributable to the high-heat manifest by embodiments hereof. Of course, such insulation considerations are significant when dealing with high temperatures prerequisite to achieve the continuous flow performance taught herein. In applications that are particularly demanding of high-heat and under extremely adverse environmental conditions of extreme cold, extensive ice-formation and the like, embodiments of the present invention would not be limited to four levels of spiral pathways, but would preferably comprise five or as many as six such levels and populated in excess of 36 heaters. This would affect the heat sink functionality of such spiral pathway plurality wherein, for the four-pathway embodiment with each pathway offset by 90°, one area of such heat sink absorbs generated heat and the other three areas disperse heat from the top and both sides—which is propagated along the spiral pathway. In effect, high-heat is first transferred from the internal heat chamber to the heat sink, and, in turn, the high-heat is transferred through the pipeline wall to the enclosed flowing viscous hydrocarbons.

Another variation of the teachings of the present invention is depicted collectively in FIGS. 9-16 which illustrate an embodiment hereof depicted in FIGS. 1-8, except having a second internal helically-configured pump 250 for further urging continuous flow of the highly-viscous hydrocarbons contemplated hereunder. To readily identify and elucidate the relationship between the various components comprising each such embodiment—a non-pump embodiment (FIGS. 1-8) and a pump embodiment (FIGS. 9-16)—the respective component-numerals are identical except that the pump-related numerals are depicted with a prime, i.e., single quote, symbol.

Figure 9A:
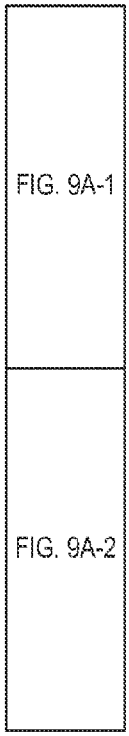
FIG. 9A depicts a front view of another preferred embodiment of the present invention, including a pump feature, subdivided into a top portion 9A-1 thereof and a bottom portion 9A-2 thereof.
Figures 1, 9A:
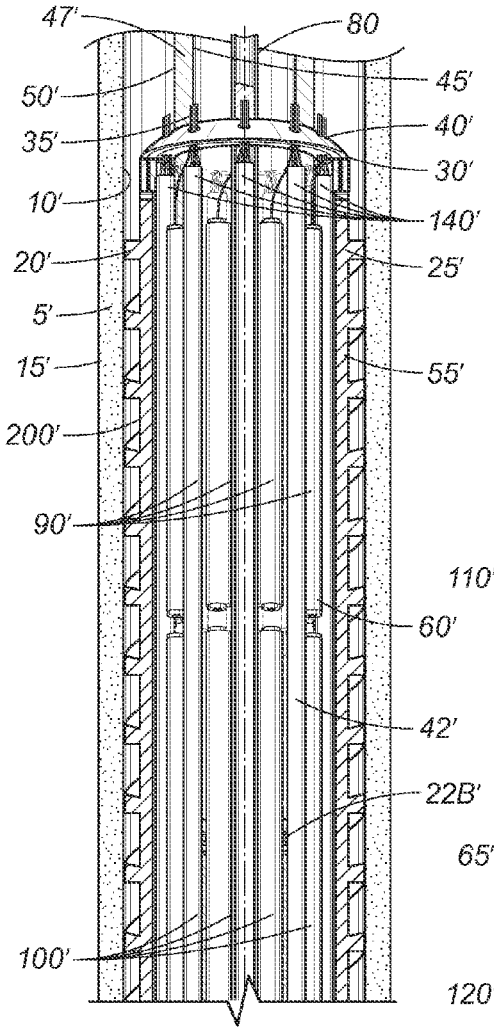
Figures 2, 9A:
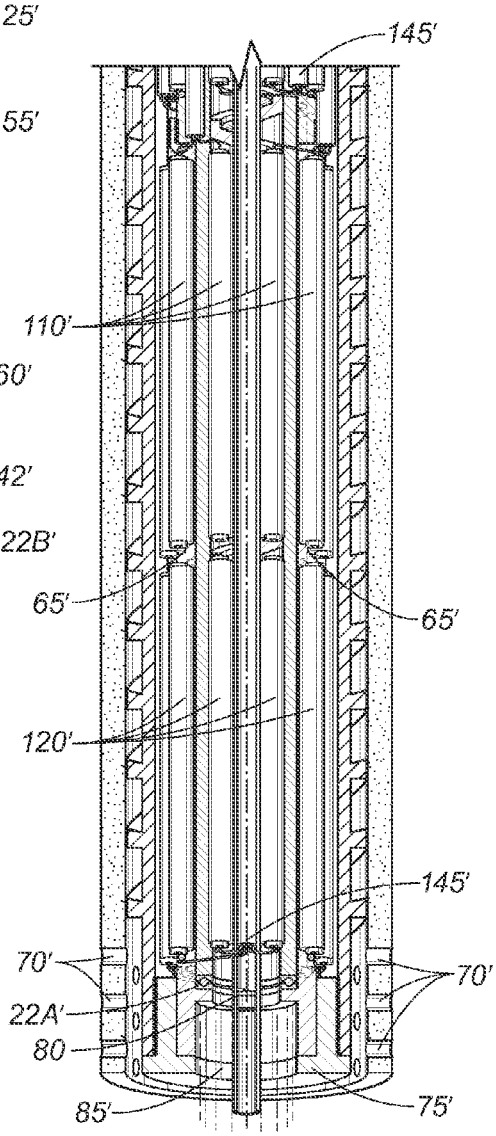
Figure 9B:
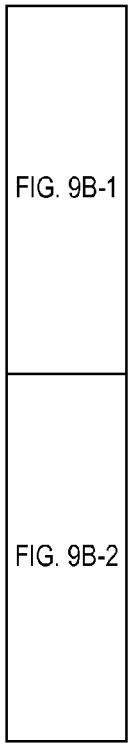
FIG. 9B depicts a simplified view of the front view depicted in FIG. 9A identifying each of the cross-sectional views depicted in FIGS. 2-8, and subdivided into a top portion 9B-1 thereof and a bottom portion 9B-2 thereof.
Figures 1, 9B:
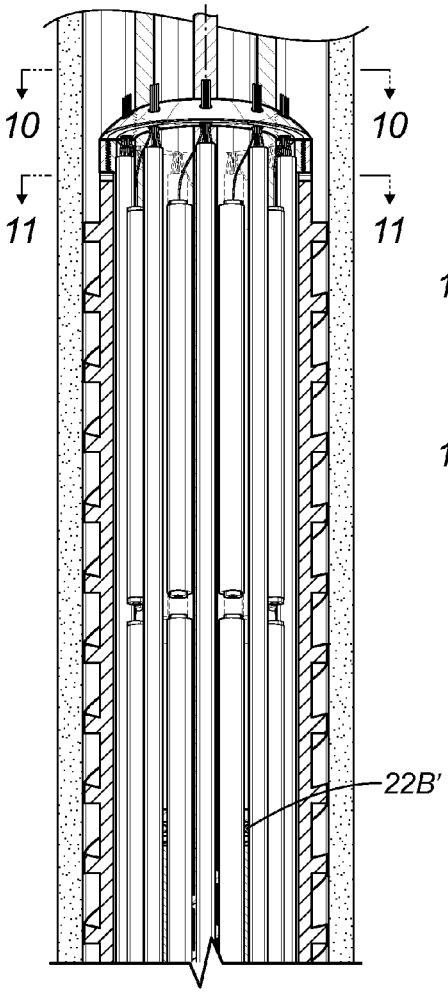
Figures 2, 9B:
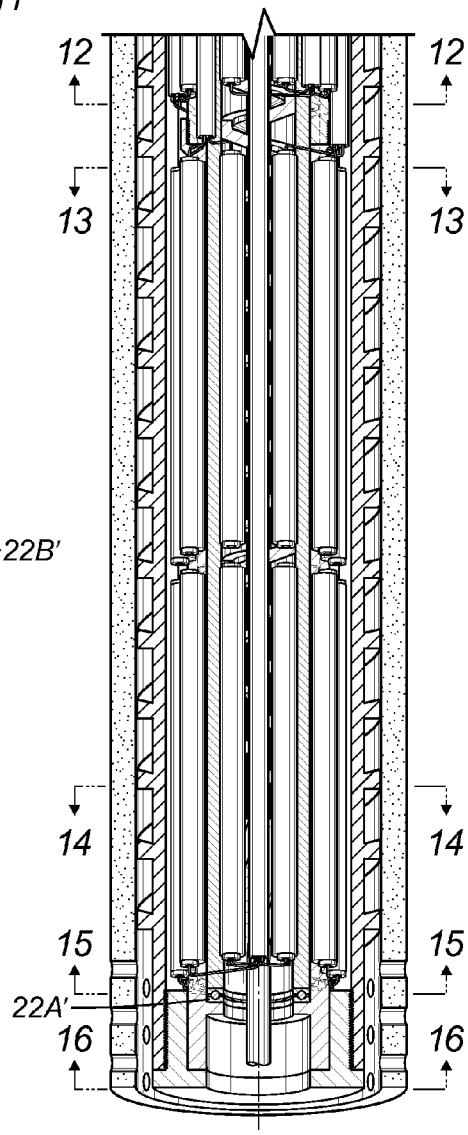
Figure 9C:
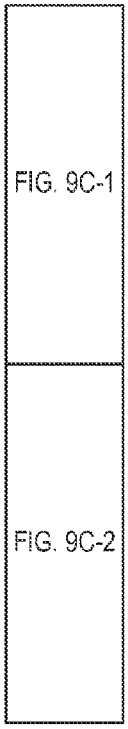
FIG. 9C depicts a perspective view of the embodiment depicted in FIGS. 9A-B, subdivided into a top portion 9C-1 thereof and a bottom portion 9C-2 thereof.
Figures 1, 9C:
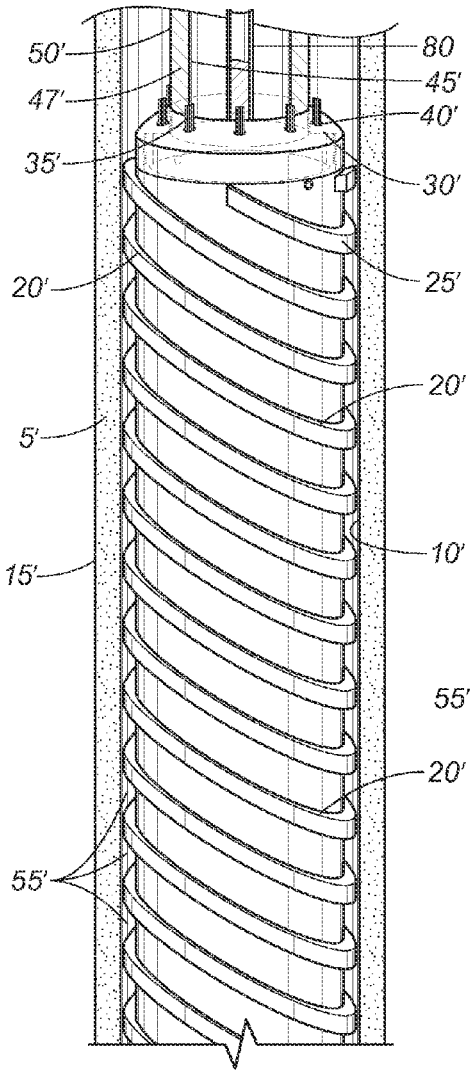
Figures 2, 9C:
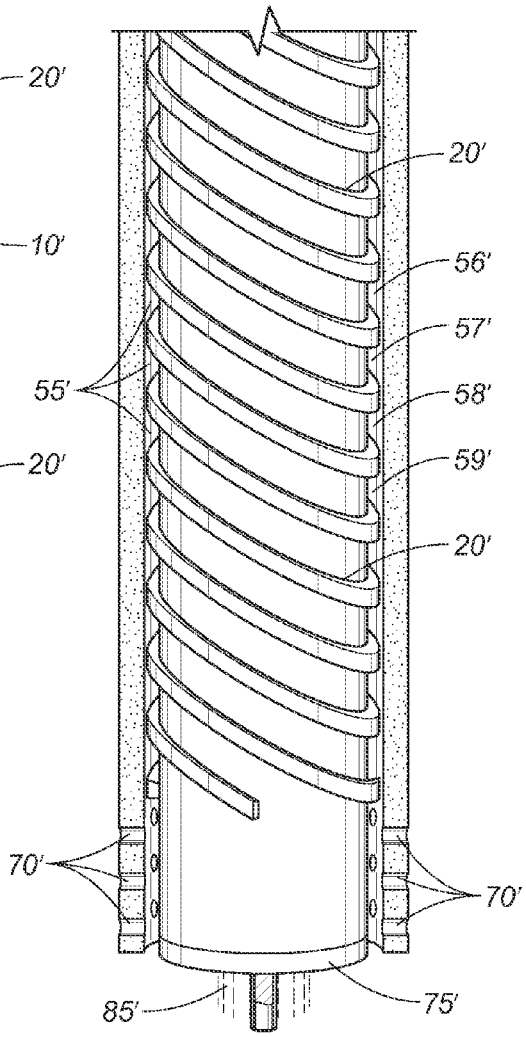
Figures 1, 2, 9D:
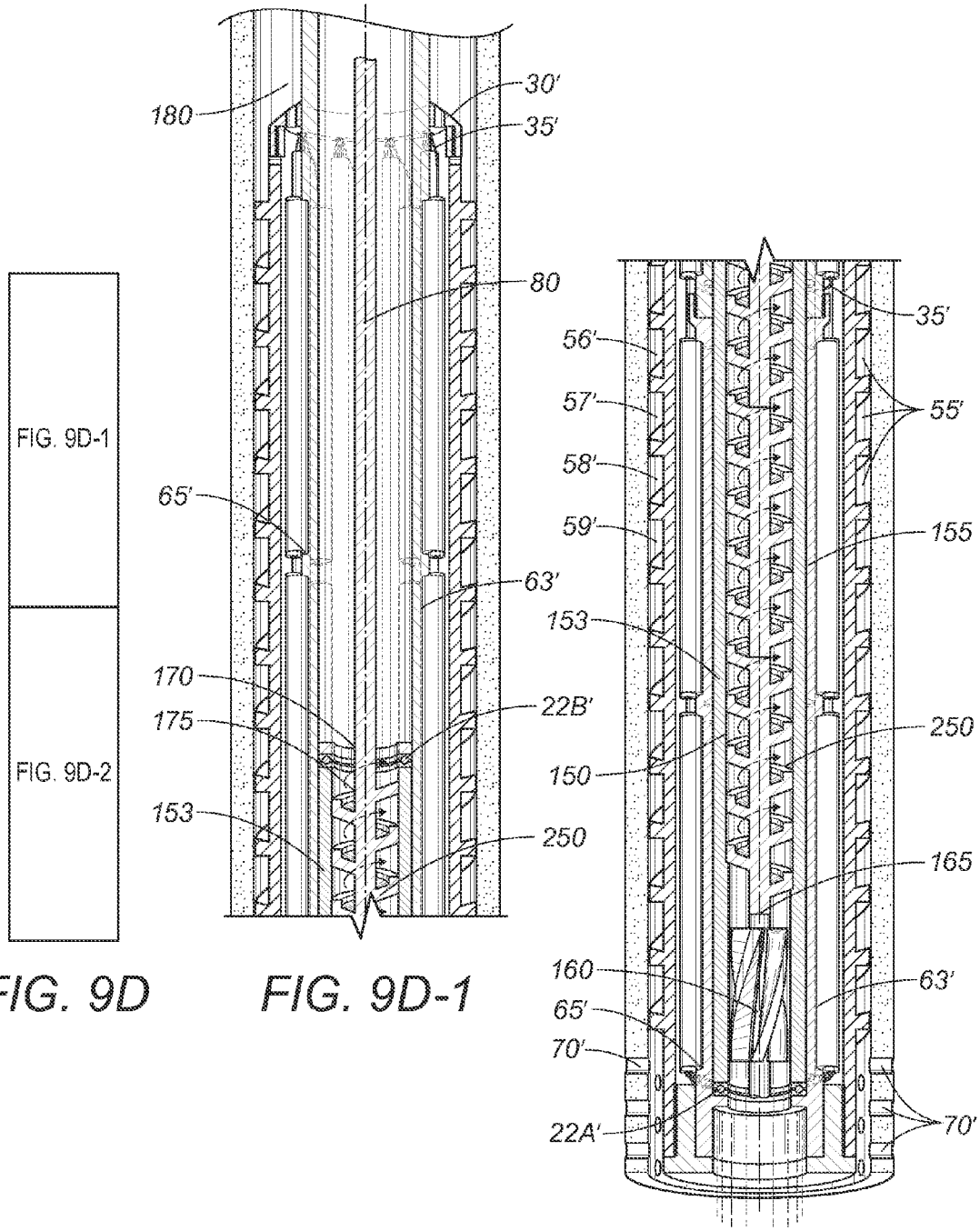
FIG. 9D depicts another front view of the embodiment depicted in FIGS. 9A-C, subdivided into a top portion 9D-1 thereof and a bottom portion 9D-2 thereof.

FIGS. 9A-E each depict a frontal view of the preferred embodiment of the instant high-temperature heat, steam and hot-fluid pump and production tool disposed downhole at a well site. FIG. 9B depicts a simplified frontal view of FIG. 9A identifying each of the cross-sectional views depicted in FIGS. 10-16. FIG. 9C depicts a frontal perspective view thereof, emphasizing the exterior spiral configuration taught hereunder. On the other hand, FIG. 9D depicts a frontal perspective view thereof, emphasizing the interior spiral configuration taught hereunder.

The present invention contemplates a steam tool that inherently affords an advanced, especially advantageous panoply of properties that engender sufficiently constant high temperatures downhole on the basis of superheated steam production and concomitant high-temperature liquid heretofore unknown for enabling efficient recovery of especially viscous oil and other viscous hydrocarbons, and a unique internal pumping capability as will hereinafter be described. It will become clear to those conversant in the downhole and fracturing arts that this panoply of advanced qualities devolve to a unique methodology for sustaining continuous, constant heat, high temperature steam, and/or hot solvent solutions or hot fluid thermal properties that are produced and sustained proximal to heavy viscous oil and other hydrocarbons, and even extra-heavy, highly viscous oil or Bitumen coal reservoirs or the like, and facilitate pumping of such recovered heavy-viscosity hydrocarbons upwards toward the well surface.

It will become evident to practitioners skilled in the art that such internal-pump embodiments of the present invention may be invoked to perform additional downhole tasks such as using the central area of the production string 47' as a tubing stem for pumping viscous oil and other viscous hydrocarbons to the well surface, while the annulus between this production tubing and the well casing 5' acts as both heat and steam transfer area that enables the plurality of heating members 60' to continue to function normally while heavy viscous hydrocarbons and associated fluids are being heated simultaneously with removal thereof from the wellbore. Such unexpected upwards pumping efficiencies are enabled on the basis of the unique pumping capability of embodiments hereof manifest by helical configuration taught herein. Through plurality of helical flowpaths 55' —individually exemplified by each flowpath 56', 57', 58' and 59' —of self-generated superheated steam and hot-temperature liquid there is afforded prolonged contact with proximal viscous hydrocarbons manifest by maximal surface area attributable to the travel of superheated steam and hot-liquid through the spiral trough structure transferring contemplated hot-heat by plurality of heaters 90', 100', 110' and 120'. It will be seen that this spiral trough structure engulfs the centralized axis of the production string and expeditiously communicates high-heat to adjacent viscous oil and other hydrocarbons during flow thereof to the well surface. Accordingly, this spiral configuration taught by the present invention is optimally emplaced in a trough disposition within the annulus located between the production tubing and well casing, thereby acting as both a high-heat and superheated steam transfer area enabling the implicated plurality of heating members to continue to function normally notwithstanding heavy viscous hydrocarbons and associated fluids being heated simultaneously with removal thereof from the wellbore.

Referring again to FIGS. 9A-E, there are shown frontal views of preferred pump embodiment 250 of the present invention which is depicted in situ in a downhole orientation. There is depicted outer casing 5' with its inside wall 10' enclosing four 90° flow paths of the fluid and steam chamber as herein described. Also shown is outer wall 15' of outer casing 5'. Multifunctional fluid and steam flow guide 20' controls fluid and steam downward spiraling movement thereof while simultaneously imparting heat sink attributes as will be hereinafter elucidated. Associated multilateral heat sink 25' absorbs heat from outside of this fluid and steam chamber on one side and transfers heat thereinto using the heat sink's other three sides for dispersing the self-generated high heat.

As will be understood by those skilled in the art, multifunctional alignment plate 30' affords a vehicle for stabilizing and aligning the electrical conduit 42' that passes through the heat chamber 25'. This alignment plate also tends to promote alignment of the heat chamber pipe walls while simultaneously sealing off the heating area disposed therethrough. It will be appreciated that the top of alignment plate 30' also functions as the base area of the electrical wiring junction area 145' for powering the plurality of heaters 60' for generating high-temperature steam prerequisite for enabling the continuous upward flow of viscous hydrocarbons contemplated herein. Thus, heater wiring 35' conducts electricity from this wiring junction area 145' to the tubular heater members 60' and for delivering electricity for imparting power thereto. Each of plurality of conduit locks 40' comprises a threaded conduit fastener that secures corresponding plurality of electrical conduit to multifunctional alignment plate 30'.

It has been found that at least nine heaters as herein described are prerequisite for each spiral level to achieve the contemplated heating threshold to produce superheated steam and hot fluids and to sustain continuous production thereof. Heater wiring for each set of three insertion heaters of such nine-heater combination should preferably be arranged in a delta configuration 145' via three conduits in a manner known in the art. It should be evident that each such conduit accommodates a delta configuration of three heaters. Since it will become apparent that embodiments of the present invention are structured with four levels of heaters incorporated into corresponding four spiral channels or troughs for flow of high-heat, superheated steam and high-heat fluids, a total of at least thirty-six insertion heaters preferably power the contemplated steam chamber to generate superheated steam inherent herein. It will be appreciated by those skilled in the art that the plurality of spiral troughs taught herein function not only as elongated continuous flowpaths for self-generated high-heat, superheated steam and high-heat fluids, but also function as heat sinks for continuously effectuating efficient heat transfer with adjacent pipeline for transporting hydrocarbons or with subsurface reservoirs in which high-viscosity hydrocarbons have been entrapped.

Indeed, it should be clear that the spiral configuration of each of the plurality of channels tend to maximize high-heat exposure of flowing water in order promote efficient generation of superheated steam. It has also been found that preferably using a special coating for insulating such heat sinks tends to promote efficient transfer of heat outward to water, thereby avoiding loss of heat inside to oil and to other hydrocarbons. An example of such coating would be reflective paint or the like. It should be evident that preferred embodiments of the present invention strive to heat only the outside of pipe where water flows in order to generate prerequisite superheated steam. It will also be understood that insulation may be invoked to circumscribe outside pipe with ceramic wrap or the like materials to assure that prerequisite high heat is specifically applied to the water cavity where superheated steam is generated.

As is well known in the art, production tubing string affords a pathway for oil and other hydrocarbons to be pumped from subsurface formations uphole to the well surface. Accordingly, oil and other hydrocarbons are pumped to the surface within cylindrical interior surface 45' of production tubing string which is, in turn, bounded by exterior surface thereof 50'. An important aspect of the present invention is spiral channel 55' that provides a plurality of guiding pathways preferably configured as helical trough structures through which admixed hot fluid, steam and superheated steam are transported through the instant steam production chamber downhole and then through well bores 70' into subterranean formations fraught with viscous oil and other viscous hydrocarbons.

Referring again collectively to FIGS. 9-16, it will be understood that each of the four spiral troughs 80', 100', 110' and 120' are offset by 90°, wherein a full circular cross-section of 360° is encompassed to promote continuous flow of superheated steam, hot liquid and hydrocarbons therethrough. Plurality of tubular heaters 60' may be obtained and configured in various lengths, varying from only one foot long to 25 feet or more, and affording many different combinations of heat production attributes and capabilities.

In FIG. 9A, there is seen plurality of heater support shoulder platforms 65' that provide support to each corresponding heater of plurality of heaters 60'. It will be seen that each such heater support shoulder platform 65' is preferably machined into outer pipe wall along with a modicum of weldment disposed upon this shoulder platform for securing and anchoring plurality of heater tubes 60' thereto.

It will be appreciated by those skilled in the art that plurality of outer casing steam and hot fluid ejection port apertures 70' is used to distribute generated superheated steam and hot-temperature fluids throughout the elongated high-surface area of spiral steam and hot fluid production channels 55' and then transferred into the wellbores 70' and/or formation sections that are fraught with viscous oil or other viscous hydrocarbons—typically found in subterranean formations such as rock, sand, shell or a mixture thereof. As depicted in FIGS. 9A-E, at the bottom of wellbore, spacing and platform base cap 75' comprises a threaded pipe plug or the like. It should be evident that this base cap closes and seals off heat chamber and simultaneously functions as a solid spacer for sealing and separating the annular area between outer surface of production tubing 50' and inner surface of outer casing 10' that encloses the heat chamber.

It will also be seen that conventional rotating rod or sucker rod 80' may optional be invoked to transfer mechanical energy to a spiral hydrocarbon and oil pumping structure 250 taught herein disposed within production tubing string 47' that axially passes through preferred embodiment of the instant high-heat and steam hot fluid downhole production apparatus. The pumping action-driven flow of hydrocarbons may preferably be augmented by longitudinally incorporating preferably a pair of bearing members 22A' and 22B' onto opposite end portions thereof in order to not only promote rotational motion thereof, but also to assure stability. Thus, referring to FIGS. 9A, D, E first bearing member 22A' is depicted at one end and a typical location of second bearing member 22B' of this bearing member pair is indicated for simplicity. Of course, the emplacement of each of these two bearing members may be virtually anywhere along the longitudinal axis so long as rotational balance is sustained. Downhole oil or other viscous hydrocarbons 85' contained within subsurface reservoir is generally depicted at bottom of the wellbore and driven upwardly therethrough as elucidated herein.

Focusing now upon the heating aspects of the present invention, it will be seen that the preferred embodiment is configured with four heating tube groups or stages 90', 100', 110' and 120'. First heating tube group 90' is configured with nine heating tubes as herein described. Similarly, second heating tube group 100' is configured with nine heating tubes akin to the plurality of heating tubes contained in first heating tube group 90'. Similarly, third heating tube group 110' is configured with nine heating tubes akin to the plurality of heating tubes contained in each of first heating tube group 90' and second tube group 100'. Similarly, fourth heating tube group 120' is configured with nine heating tubes akin to the plurality of heating tubes contained in each of first heating tube group 90', second heating tube group 100', and third heating tube group 110'.

It should be understood that, while the preferred embodiment of the present invention is illustrated with four stages of nine heating elements, the instant apparatus taught hereunder may optionally be expanded as a function of the number of heat and steam related components, so long as the contemplated upward flow of high-viscosity hydrocarbons and the like is achieved via the driving force of continuous contact with high-temperature hot fluid and steam through the spirally-configured troughs as elucidated herein. It will also be seen that there are depicted nine insulated conduit ends 140' that terminate in a wire connecting junction area atop alignment base plate 30' disposed in the upper portion of the instant embodiment. It further terminates at the different lower stage levels in which each of the heating tubes different stage insulated conduit wiring connection commences.

It will be observed upon lower portion of production tubing 47' depicted in FIGS. 9A-E that there are depicted three different elevations of exit ports 70' corresponding to the lowest level of the downward spiraling of four channels or troughs wherein heat is continuously transferred into fluids in order to create high-temperature steam and hot fluids that flow therethrough into this plurality of exit ports into the wellbore's outer casing 15', and ultimately into the formation's rock, shell, sand, and other attributes. It should be evident that this high-temperature influence upon such formations proximal to the wellbore tend to substantially eliminate flow impediments and thus cause release of oil and other hydrocarbons entrapped therein.

Figure 9E:
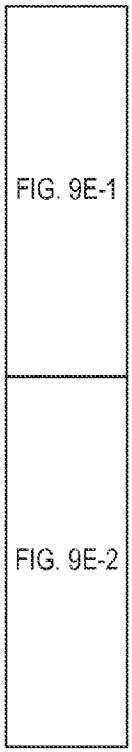
FIG. 9E depicts another frontal view of the embodiment depicted in FIGS. 9A-D, subdivided into a top portion 9E-1 thereof and a bottom portion 9E-2 thereof.
Figures 1, 9E:
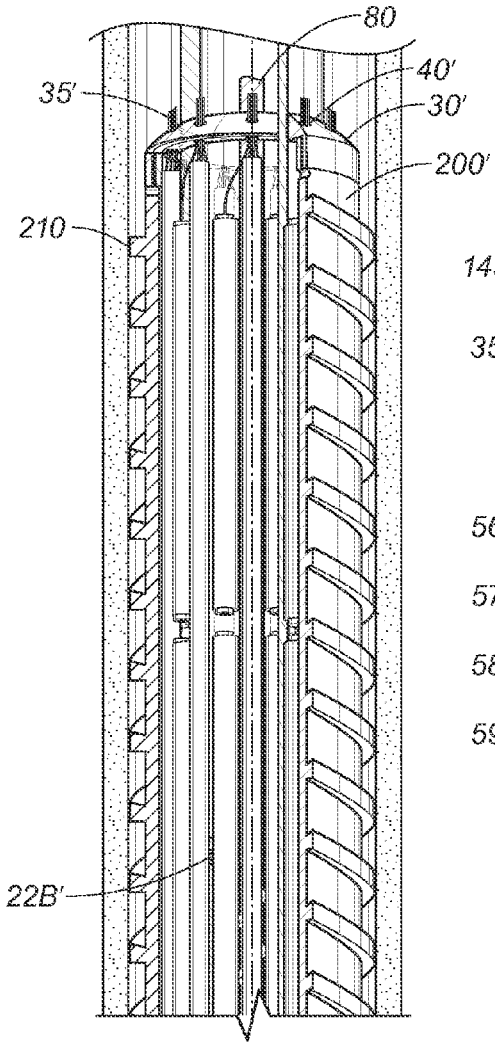
Figures 2, 9E:
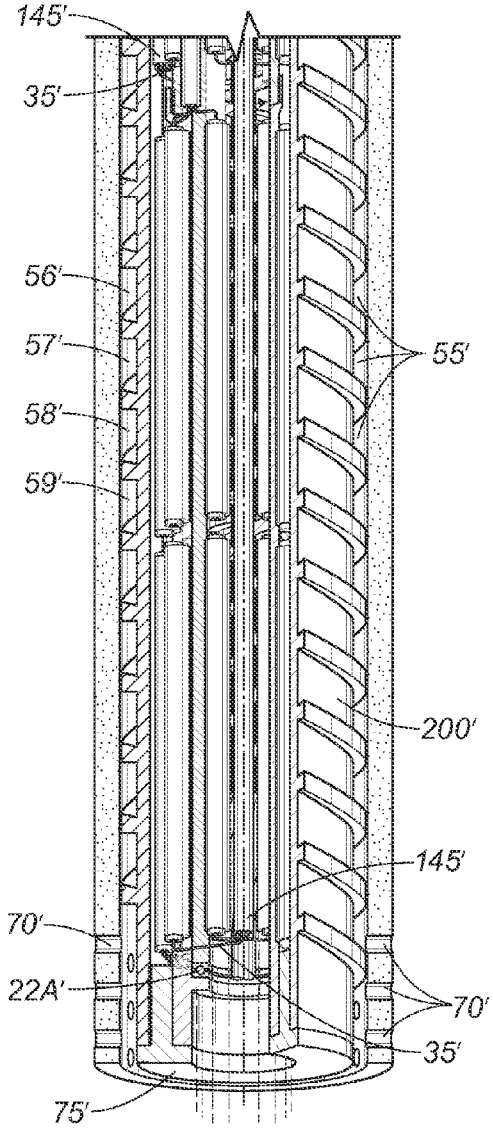
Figure 12:
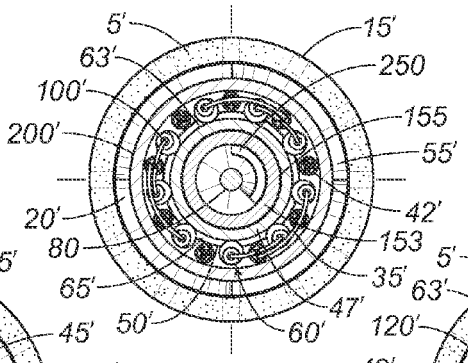
FIG. 12 depicts a cross-sectional view of the embodiment depicted in FIGS. 9A-E, wherein the section is along line 12-12.
Figure 10:
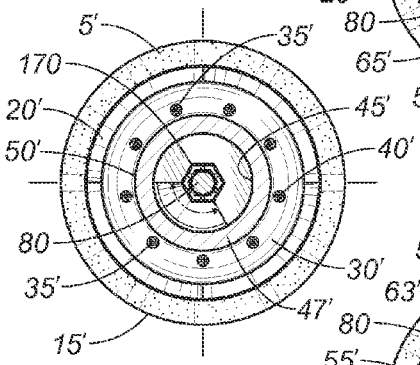
FIG. 10 depicts an upper cross-sectional view of the embodiment of the present invention depicted in FIGS. 9A-E, wherein the section is along line 10-10.
Figure 15:
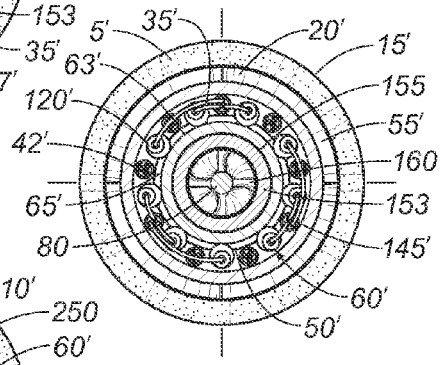
FIG. 15 depicts a cross-sectional view of the embodiment depicted in FIGS. 9A-E, wherein the section is along line 15-15.
Figure 13:
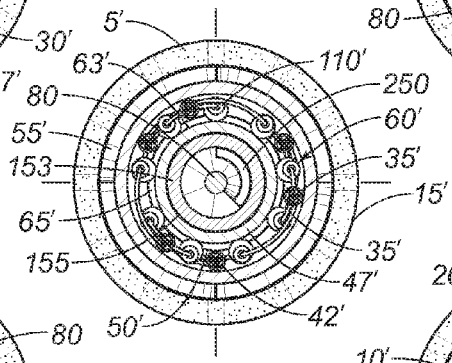
FIG. 13 depicts a cross-sectional view of the embodiment depicted in FIGS. 9A-E, wherein the section is along line 13-13.
Figure 11:
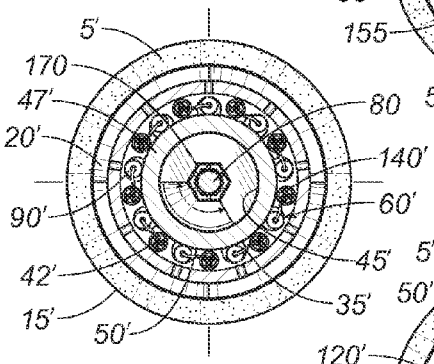
FIG. 11 depicts a cross-sectional view of the embodiment depicted in FIGS. 9A-E, wherein the section is along line 11-11.
Figure 16:
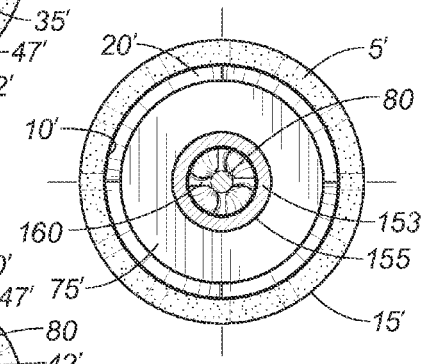
FIG. 16 depicts a cross-sectional view of the embodiment depicted in FIGS. 9A-E, wherein the section is along line 16-16.
Figure 14:
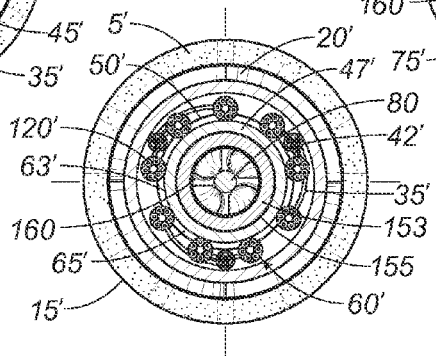
FIG. 14 depicts a cross-sectional view of the embodiment depicted in FIGS. 9A-E, wherein the section is along line 14-14.
Figure 17:
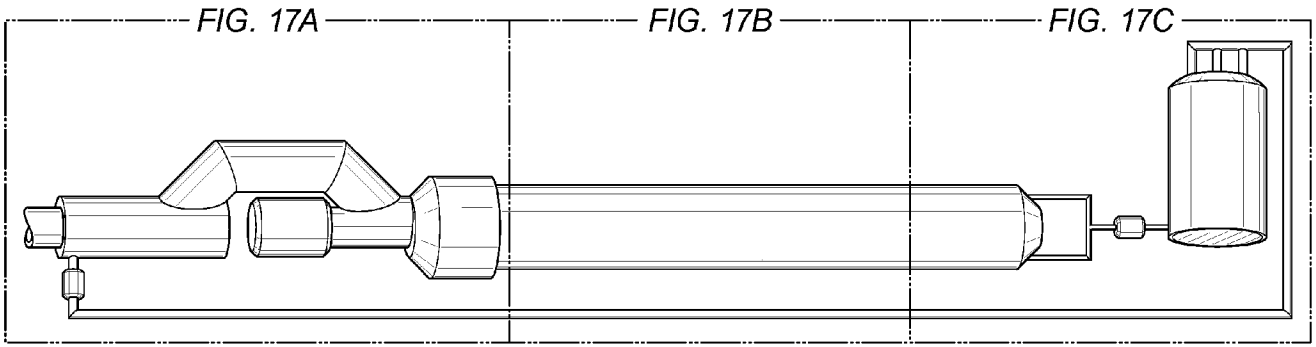
FIG. 17 depicts a front exterior view of another preferred embodiment of the present invention, adapted to support continuous flow of viscous hydrocarbons through pipelines situated on or proximal to the ground surface, including a pump feature and an adjacent pre-heater apparatus, subdivided into a left portion 17A thereof, a middle portion 17B thereof, and a right portion 17C thereof.
Figure 17A:
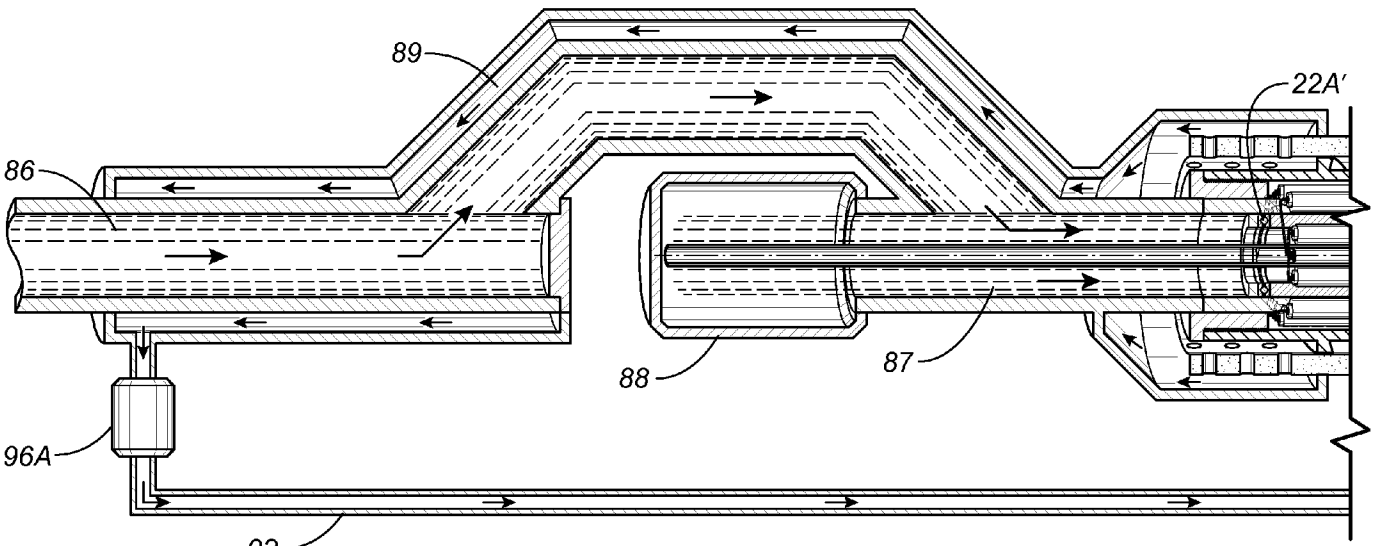
FIG. 17A depicts a perspective cross-sectional view of the left portion of the front exterior view depicted in FIG. 17.
Figure 17B:
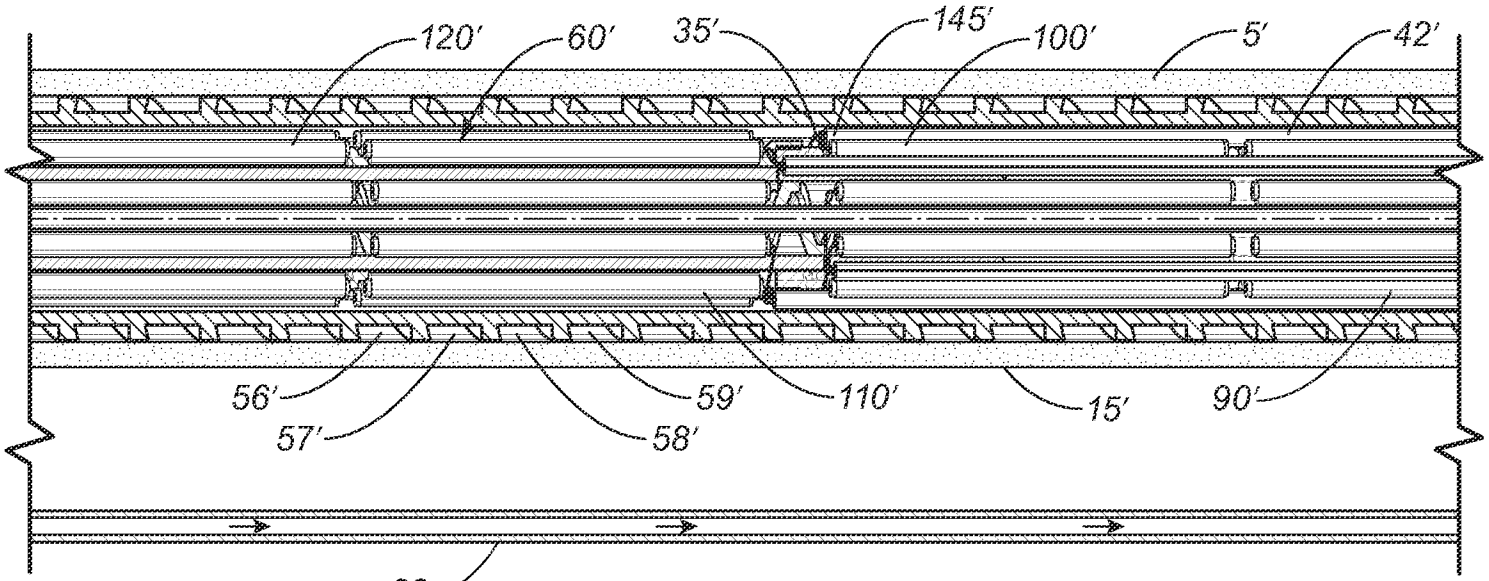
FIG. 17B depicts a perspective cross-sectional view of the middle portion of the front exterior view depicted in FIG. 17.
Figure 17C:
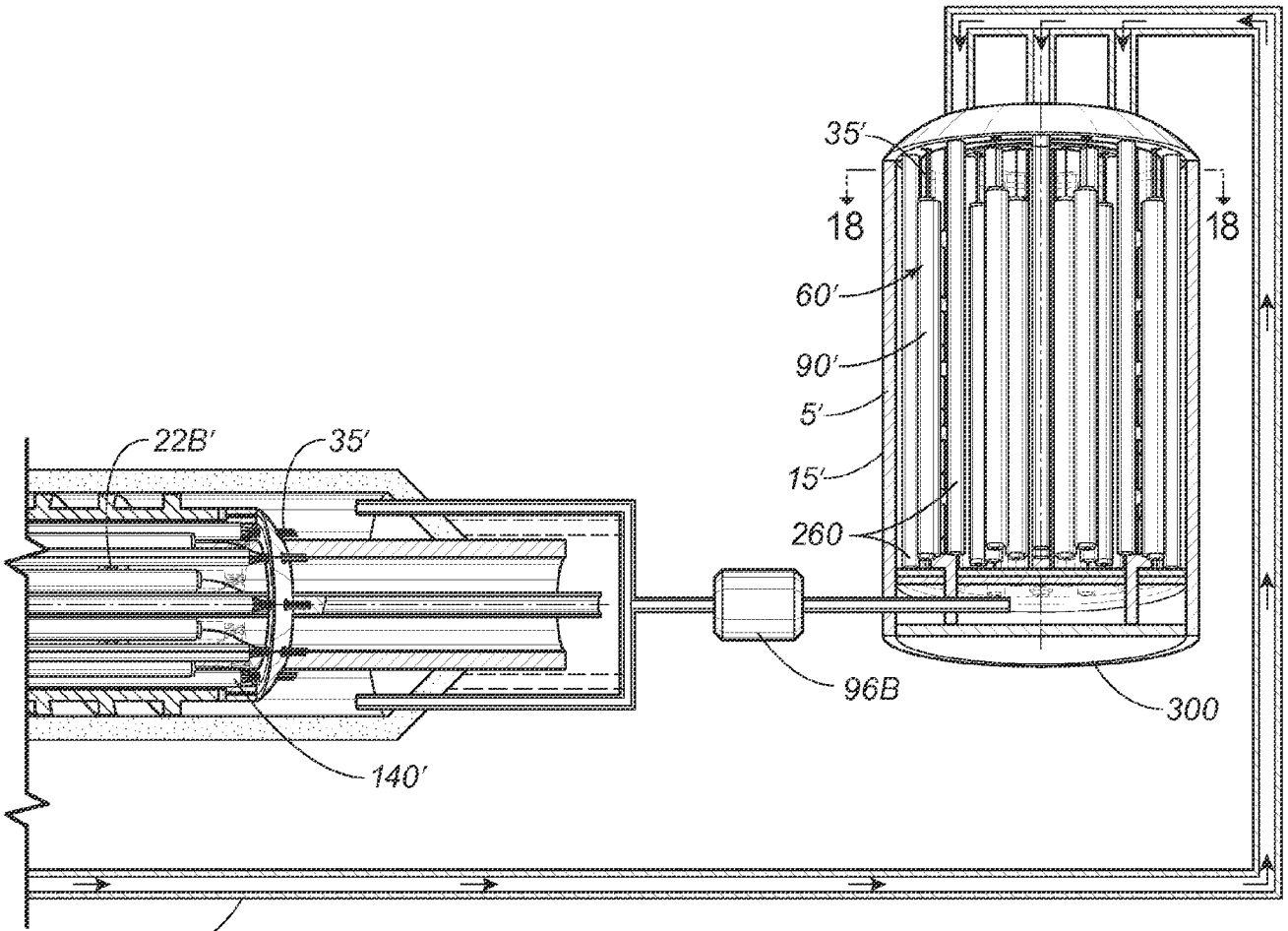
FIG. 17C depicts a perspective cross-sectional view of the right portion of the front exterior view depicted in FIG. 17.

It will be appreciated that an optional high temperature oil well pump could be included in embodiments of the instant methodology for generating and sustaining oil well downhole high-temperature steam production and consequent recovery of oil and other hydrocarbons as contemplated hereunder. Referring now collectively to FIGS. 9D-E, there is seen elongated pump 250 disposed spirally axially within production tubing in a helical configuration. This helical section of the present invention effectively uplifts crude hydrocarbons while continuously rotating through 360°. It will be understood that this protocol enables each lifting section to function synchronously thereby urging subterranean minerals that are dispersed throughout the wellbore to be driven to the surface in unison. Interior pipe wall surface 150 of interior pipe 153 encloses elongated helical pipe pump section 250 by sealing off the pump sections that lift the crude oil and other hydrocarbons while this helical pump section continuously rotates through 360° thereby enabling each successive lifting stage to function in unison to efficiently force the minerals through the well production tubing string upwardly toward the well surface.

It will be seen that outside wall 155 of the elongated helical pump encloses the elongated spiraling helical section and thus seals pump sections that serve to lift crude oil and other hydrocarbons while effectuating unified and coordinated lifting thereof as hereinbefore described. Four preferably sharp edges 160 assist sustaining bottom section of the instant elongated helical pump centrally aligned within the casing, for enclosing the pump while functioning akin to a paper-shredder to effectively break-up accumulations or clumps of high-viscosity tar balls and like heavy viscous hydrocarbons. These edges are preferably offset 90° to afford maximum break-down of heavy viscosity materials. Numeral 165 depicts the connection point at which the four sharp offset edges tend to reinforce each other in the daunting task of tearing apart the heavy viscosity hydrocarbons and like materials. It should be evident to those skilled in the art that such powerful tearing and shredding action is prerequisite for avoiding inhibitions to the contemplated smooth, continuous upward flow of hydrocarbons to the well surface.

Of course, it should be appreciated that in other implementations of the present invention, along pipelines and the like upon or above ground or waterways, this shredding action is essential to avoid clumping and the like that would prevent continuous hydrocarbon fluid-flow therethrough. Still referring specifically to FIGS. 9D-E, there is seen highest level 170 of the instant elongated spiral pump section 250 that serves to seal off a plurality of pump sections that lift hydrocarbons and the like while continuously rotating through 360° as elucidated herein. Numeral 175 depicts connection point of the mechanical energy transfer rod and the elongated spiral pump hereof. It will be understood that such mechanical energy transfer rods preferably screwably interconnect where the elongated spiral pump terminates, fastening together at this flush rod connection point, thereby creating a union with a motor disposed at the well surface. Fluid and air area 180 disposed between the outside wall of the production string and inside wall of the well casing will be seen as where fluid and air pass through in order to reach high-temperature heat, superheated steam and hot fluid heating production chamber contemplated hereunder. This high-temperature heat, superheated steam and hot fluid exit through plurality of exhaust ports 185 and are distributed through the maximum surface area associated with elongated spiral trough-like channels described herein.

It will be readily understood that this novel heating production chamber is where heat, superheated steam, and hot fluids are transferred into rock, shale, sand and various other challenging soil formations, whereupon forced release of entrapped viscous crude oil and other viscous hydrocarbons is instigated and then facilitated by being drained therefrom into the well bore to be subsequently pumped to the well surface by the unique pump protocol taught herein. Combination alignment and base plate 30' functions as a means for both stabilizing and aligning the electrical conduit 42' that passes through the heat chamber 200, while also sealing off the heating chamber area. It will be seen that the top of the plate 30' also serves as the base of a junction box that encloses the electrical wiring hereof 35'. Heating chamber 200' is the integral to the pathway for high-temperature heat to travel therethrough as fluids are heated in the set of four downward spiraling fluid stream guides that are disposed in 90° offsets relative to each other; of course, this heat chamber is enclosed circumferentially throughout 360° by pipe casings. Outside wall of this heating chamber separates the plurality of heaters 60' from flowing water because the heaters are enmeshed within the inside walls thereof. It will further be observed that representative location 210 within the helical structure of the preferred embodiment corresponds to a downward-spiraling fluid stream guide that simultaneously functions as a multilateral heat sink that transfers heat from outside the heat chamber thereinto, where such heat is required to heat the steam and fluids while traversing therethrough. It will be understood that the elongated spiral pump embodiment taught hereunder achieves excellent crude oil and other viscous hydrocarbons lifting capacity enabled by the efficient self-generation of high heat, superheated steam and hot fluids, coupled with inherent high-heat exchange.

As hereinbefore described, other variations and modifications will, of course, become apparent from a consideration of the structures and techniques hereinbefore described and depicted. The downhole implementation herein described in detail may be used in a hydrocarbon production stream virtually at any level in a well bore. Similar to scenarios such as Canadian oil sands and oil fields fraught with highly viscous hydrocarbons, embodiments of the present invention may be adapted for use to effectively heat and release such hydrocarbons into adjacent production wells in a manner and with efficiency and reliability heretofore unknown. Indeed, the instant high-heat tool has been designed to self-generate and inject superheated steam and high-temperature fluids into a diversity of contemporary high-viscosity hydrocarbon extraction and/or transfer applications.

Figure 18:
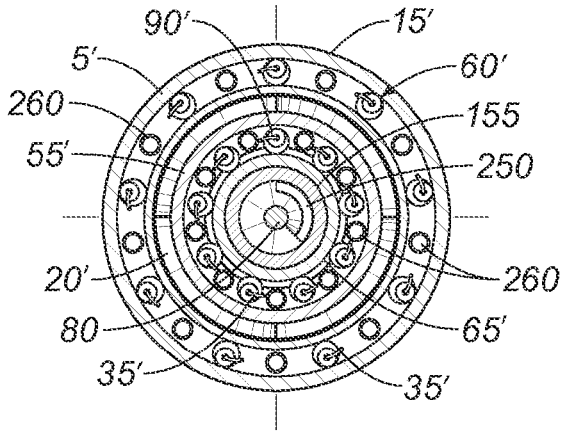
FIG. 18 depicts a cross-sectional view of the multi-heater configuration within pre-heater apparatus portion of the embodiment depicted in FIG. 17C, wherein the section is along line 18-18.
Figure 19:
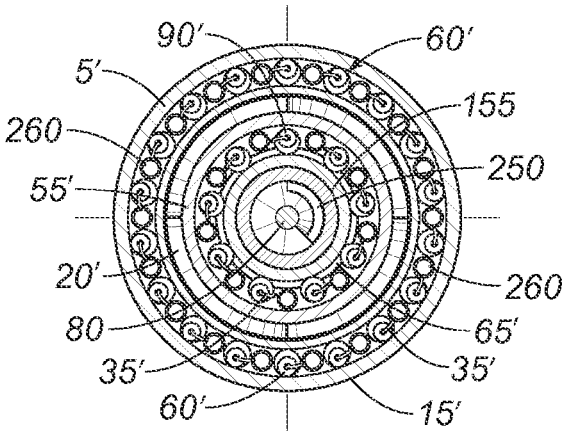
FIG. 19 depicts a cross-sectional view of an alternative configuration of the multi-heaters depicted in FIG. 18.
Figure 20:
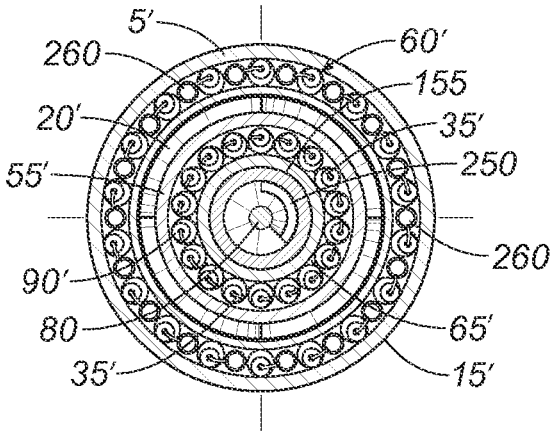
FIG. 20 depicts a cross-sectional view of another alternative configuration of the multi-heaters depicted in FIG. 18.

For instance, an alternative embodiment may be similarly configured with plurality of helical flowpaths for accommodating fluid-flow of ordinarily high-viscosity hydrocarbons in pipelines disposed substantially horizontally and proximal to the surface. Referring now to FIGS. 17, 17A-C, and 18-20 there is depicted a surface-positioned embodiment of the present invention wherein viscous hydrocarbons flow through pipeline 86 under the influence of motor 88 driving the instant tool comprising plurality of well-insulated successive heater groups 90', 100', 110' and 120' as hereinbefore described. Also shown is bearing member 22A' and the location of its corresponding paired bearing member 22B'. An optional feature hereof is water or other fluid recycle comprising lower recycle line 92 with such water being driven by small pump 96A into pre-heater member 300 and then heated via an optional heater group and implicated plurality of wires with associated conduit end members and other similarly situated heater groups as hereinbefore described. As should be evident to those skilled in the art, water exiting from pre-heater 300 is, in turn, driven by another small pump 96B into return pipeline 89. FIG. 18 depicts a cross-sectional view along line 18-18 in FIG. 17C wherein a configuration of 18 heaters is illustrated, with 9 heaters disposed inside and 9 heaters disposed outside. More particularly, there is seen centrally disposed sucker rod 80', within circumferentially disposed heater support platform 65' in turn disposed within the helical pump configuration 250 that inherently affords auxiliary pumping capabilities as taught herein. As depicted in this view are casing 5' bounded by its outer wall 15'. Other heater configurations are depicted in FIG. 19 wherein 27 heaters are illustrated, with 9 heaters disposed inside and 18 heaters disposed outside; and FIG. 20 wherein a configuration of 36 heaters is illustrated, with 18 heaters disposed inside and 18 heaters disposed outside. It will of course be appreciated by those skilled in the art that the prescribed extent of preheating imparting to the recycle stream will be functionally related to the number of readily interchangeable heating elements incorporated into the preheater. Small pump 96B drives heated recycled water or other fluids back through upper recycle line 89 into the plurality of spiral troughs or channels to transfer high-heat and steam to the continuously flowing viscous hydrocarbons. It will be understood that reference to such small pumps as 96A-B contemplates only about 10-15 psi, just sufficient impetus to sustain the movement of the recycled water or other fluids. A similar embodiment would lend itself to hydrocarbon pipeline applications that must function in extreme cold environments such as in the North Sea that load hydrocarbons onto ships, tankers, and the like.

It should also be understood by those skilled in the art that insertion and like heaters incorporated into embodiments hereof should be capable of generating high temperatures as high as 2,000° F. and even higher if environmental conditions demand. Nevertheless, it will be appreciated that the longevity of such heaters will be substantially increased if high temperatures on the order of 1,000° F. rather than temperatures on the order of 2,000° F. are invoked. It should be evident that such improved longevity, as much as two-to-three times longer anticipated to constitute several years' service life, is attributable to fewer demands being imposed upon the internal electronic components thereof. As hereinbefore described, the concomitant controllers would be set appropriately to operate with constant performance to achieve acceptable high temperatures generally in the range of 1,000° F. to 2,000° F.

It will also be appreciated that a feature of embodiments of the present invention may and preferably should recirculate the water to reproduce superheated steam therefrom. This procedure would, of course, reduce water consumption. After self-generated heat is transferred to upwardly flowing hydrocarbons as hereinbefore described, the steam would be returned to the water externally at the beginning of heating cycle. Thus, this steam would heat the to-be recycled water which would be somewhat reconstituted to allow for minor loss of volume. In effect, this would extend the length or reach of the steam wherein the recycled already heated water efficiently generates more superheated steam for sustaining the continuous flow of otherwise viscous crude oil and other hydrocarbons within pipelines or loading ships, tanks or refinery surface pipes. Another aspect of embodiments hereof is to enclose implicated pathways with sufficient insulation to maximize transfer of heat to high-viscosity hydrocarbons—thereby benefitting from increased fluidized hydrocarbon pumping capacity—while simultaneously minimizing heat loss.

Yet another implementation of embodiments hereof, for example in downhole applications, would be to incorporate a plurality of instant tools at various locations downhole. Then, as superheated steam exits the plurality of steam ports and as hot liquid descends downhole, this water would again be heated to the prescribed constant high temperature (in the lower-placed tool) thereby assuring steady state flow of superheated steam and high-temperature fluids within the spiral trough-like pathways herein described. It will be readily recognized by those skilled in the art that this benefit may also be achieved by appropriately situating a series of such high-heat tools along a pipeline so that the pipeline is continuously kept sufficiently heated to overcome any viscosity-based inhibitions and to sustain fluidized hydrocarbons throughout the pipeline.

It has been found that applications having outer casing and the like inherently afford sufficient insulation to minimum temperature changes and thus avoid any adverse effects attributable to the high-heat manifest by embodiments hereof. Of course, such insulation considerations are significant when dealing with high temperatures prerequisite to achieve the continuous flow performance taught herein. In applications that are particularly demanding of high-heat and under extremely adverse environmental conditions of extreme cold, extensive ice-formation and the like, embodiments of the present invention would not be limited to four levels of spiral pathways, but would preferably comprise five or as many as six such levels and populated in excess of 36 heaters. This would affect the heat sink functionality of such spiral pathway plurality wherein, for the four-pathway embodiment with each pathway offset by 90°, one area of such heat sink absorbs generated heat and the other three areas disperse heat from the top and both sides—which is propagated down the spiral pathway. In effect, high heat is first transferred from the internal heat chamber to the heat sink, and, in turn, transferred through the pipeline inner wall.

Other variations and modifications will, of course, become apparent from a consideration of the structures and techniques hereinbefore described and depicted. Accordingly, it should be clearly understood that the present invention is not intended to be limited by the particular features and structures hereinbefore described and depicted in the accompanying drawings, but that the present invention is to be measured by the scope of the appended claims herein.

What is claimed is:

1. At a well site having access to source water, and having wellbore casing adapted for axially and centrally receiving production tubing downhole, a tool for self-generating superheated steam, and configured for promoting continuous contact between said superheated steam and viscous hydrocarbons embedded within a subterranean formation and adapted for enabling extraction of said viscous hydrocarbons from said subterranean formation and for facilitating continuous flow of said viscous hydrocarbons upwards to the well surface within said production tubing, said tool comprising:

a first plurality of successive spiral trough flowpaths disposed between said wellbore casing and said production tubing;

each spiral flowpath of said first plurality of spiral flowpaths offset from another neighboring spiral flowpath of said first plurality of spiral flowpaths and comprising a trough channel for accommodating flow of said superheated steam therethrough;

said each spiral flowpath further comprising a second plurality of high-temperature heating members configured for generating high-temperatures prerequisite for generating steady-state superheated steam, for transferring heat from said superheated steam through a third plurality of holes disposed in said wellbore casing, said third plurality of holes located proximal to said subterranean formation, for reducing said viscosity of said embedded viscous hydrocarbons and thereby effectuating release thereof; and said first plurality of spiral flowpaths providing a heat sink for enabling said continuous high-temperature heat exchange between said superheated steam communicated through the walls of said first plurality of successive spiral trough flowpaths to said viscous hydrocarbons being urged to continuously flow upwardly through said production tubing.

2. The tool recited in claim 1, wherein each said heater member of said second plurality of high-temperature heater members comprises a sheathed insulated insertion heater embedded into an outer wall of a spiral flowpath of said first plurality of spiral flowpaths.

3. The tool recited in claim 2, wherein said sheath of each said heater of said second plurality of high-temperature heater members comprises Inconel 600.

4. The tool recited in claim 1, wherein said offset is 90°.

5. The tool recited in claim 1, wherein said first plurality of spiral flowpaths consists of 4 spiral flowpaths.

6. In a substantially horizontal surface pipeline disposed at or near the ground surface, a tool for self-generating superheated steam configured for promoting continuous contact between said steam and viscous hydrocarbons contained within said surface pipeline, and adapted for enabling said viscous hydrocarbons to continuously fluid-flow through said pipeline, said tool comprising:

a first plurality of successive spiral trough flowpaths disposed circumferentially of said pipeline;

each spiral flowpath of said first plurality of spiral flowpaths offset from another neighboring spiral flowpath of said first plurality of spiral flowpaths and comprising a trough channel for accommodating flow of said superheated steam therethrough; and each said spiral flowpath of said first plurality of spiral flowpaths further comprising a second plurality of high-temperature heating members configured for generating high-temperatures prerequisite for generating steady-state superheated steam, for providing a heat sink for enabling said continuous sustained high-temperature heat exchange between said superheated steam communicated through the walls of said first plurality of successive spiral trough flowpaths to said viscous hydrocarbons being urged to continuously flow substantially horizontally through said surface pipeline.

7. The tool recited in claim 6, wherein each said heater member of said second plurality of high-temperature heater members comprises a sheathed insulated insertion heater embedded into an outer wall of a spiral flowpath of said first plurality of spiral flowpaths.

8. The tool recited in claim 7, wherein said sheath of each said heater of said second plurality of high-temperature heater members comprises Inconel 600.

9. The tool recited in claim 6, wherein said offset is 90°.

10. The tool recited in claim 6, wherein said first plurality of spiral flowpaths consists of 4 spiral flowpaths.

11. At a well site having access to source water, and having wellbore casing adapted for axially and centrally receiving production tubing downhole, a tool for self-generating superheated steam, and configured for promoting continuous contact between said steam and viscous hydrocarbons embedded within a subterranean formation and adapted for enabling extraction of said viscous hydrocarbons from said subterranean formation and for facilitating continuous flow of said viscous hydrocarbons upwards to the well surface within said production tubing, said tool comprising:

a first plurality of successive spiral trough flowpaths disposed between said wellbore casing and said production tubing;

each spiral flowpath of said first plurality of spiral flowpaths has a first offset from another neighboring spiral flowpath of said first plurality of spiral flowpaths and comprising a trough channel for accommodating flow of said steam therethrough;

said each spiral flowpath further comprising a second plurality of high-temperature heating members configured for generating high-temperatures prerequisite for generating steady-state superheated steam, for transferring heat from said superheated steam through a third plurality of holes disposed in said wellbore casing, said third plurality of holes located proximal to said subterranean formation, for reducing said viscosity of said embedded viscous hydrocarbons and thereby effectuating release thereof;

a fourth plurality of successive spiral trough flowpaths disposed axially within said production tubing, for providing pumping capability;

each spiral flowpath of said fourth plurality of spiral flowpaths has a second offset from another neighboring spiral flowpath of said fourth plurality of spiral flowpaths and comprising a trough channel for accommodating flow of said superheated steam therethrough, and each said spiral flowpath further comprising a fifth plurality of high-temperature heating members configured for generating high-temperatures prerequisite for generating steady-state superheated steam; and said first plurality of spiral flowpaths and said fourth plurality of spiral flowpaths simultaneously providing heat sinks for enabling said continuous high-temperature heat exchange between said superheated steam communicated through the walls of each of said first plurality and said fourth plurality of successive spiral trough flowpaths to said viscous hydrocarbons being urged to continuously flow upwardly through said production tubing.

12. The tool recited in claim 11, wherein each said heater member of said second plurality of high-temperature heater members comprises a sheathed insulated insertion heater embedded into an outer wall of a spiral flowpath of said first plurality of spiral flowpaths.

13. The tool recited in claim 12, wherein said sheath of each said heater of said second plurality of high-temperature heater members comprises Inconel 600.

14. The tool recited in claim 12, wherein said sheath of each said heater of said fifth plurality of high-temperature heater members comprises Inconel 600.

15. The tool recited in claim 11, wherein said first offset is 90°.

16. The tool recited in claim 11, wherein said first plurality of spiral flowpaths consists of 4 spiral flowpaths.

17. The tool recited in claim 11, wherein each said heater member of said fourth plurality of high-temperature heater members comprises a sheathed insulated insertion heater embedded into an outer wall of a spiral flowpath of said fourth plurality of spiral flowpaths.

18. The tool recited in claim 11, wherein said second offset is 90°.

19. The tool recited in claim 11, wherein said fourth plurality of spiral flowpaths consists of 4 spiral flowpaths.

* * * * *

UNITED STATES PATENT AND TRADEMARK OFFICE

CERTIFICATE OF CORRECTION

PATENT NO. : 8,833,440 B1
APPLICATION NO. : 14/080690
DATED : September 16, 2014
INVENTOR(S) : Douglas Ray Dickinson It is certified that error appears in the above-identified patent and that said Letters Patent is hereby corrected as shown below:

On title page, beneath "United States Patent," the inventor's name is misspelled.

"Dicksinson" should be -- Dickinson --.

On title page, line identified by numeral (71), Applicant's name is misspelled.

"Douglas Ray Dicksinson" should be -- Douglas Ray Dickinson --.

On title page, line identified by numeral (72), Inventor's name is misspelled.

"Douglas Ray Dicksinson" should be -- Douglas Ray Dickinson --.

On title page, on the line following numeral (22), "Related U.S. Application Data" is omitted.

-- Related U.S. Application Data

Provisional application No. 61/726,013, filed on Nov. 14, 2012; Provisional application No. 61/865,509, filed on Aug. 13, 2013; Provisional application No. 61/875,260, filed on Sep. 9, 2013; Provisional application No. 61/885,029, filed on Oct. 1, 2013. --.

Signed and Sealed this
Eighteenth Day of August, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,833,440 B1
APPLICATION NO. : 14/080690
DATED : September 16, 2014
INVENTOR(S) : Dickinson It is certified that error appears in the above-identified patent and that said Letters Patent is hereby corrected as shown below:

Title Page, on the line following item (22),
"Provisional application No. 61/726,013, filed on Nov. 14, 2012; Provisional application No. 61/865,509, filed on Aug. 13, 2013; Provisional application No. 61/875,260, filed on Sep. 9, 2013; Provisional application No. 61/885,029, filed on Oct. 1, 2013." (as inserted in the Certificate of Correction issued August 18, 2015) is deleted and patent is to be returned to its original state excluding the benefit of priority claim to prior-filed provisional applications.

Signed and Sealed this
Twenty-ninth Day of September, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,833,440 B1
APPLICATION NO. : 14/080690
DATED : September 16, 2014
INVENTOR(S) : Douglas Ray Dickinson It is certified that error appears in the above-identified patent and that said Letters Patent is hereby corrected as shown below:

On title page, item (12), beneath "United States Patent" the inventor's last name is misspelled.

"Dicksinson" should be -- Dickinson --

On title page, line identified by item (71), Applicant's name is misspelled.

"Douglas Ray Dicksinson" should be -- Douglas Ray Dickinson --

On title page, line identified by item (72), Inventor's name is misspelled.

"Douglas Ray Dicksinson" should be -- Douglas Ray Dickinson --

On title page, on line following item (22), insert "Related U.S. Application Data".

-- Related U.S. Application Data

Application No. 14/080,690 claims benefit of each of Provisional Application No. 61/726,013 filed Nov. 14, 2012; Provisional Application No. 61/865,509 filed Aug. 13, 2013; Provisional Application No. 61/875,260 filed Sep. 9, 2013; Provisional Application No. 61/885,029 filed Oct. 1, 2013. --

Signed and Sealed this
First Day of March, 2016

Michelle K. Lee

Michelle K. Lee
*Director of the United States Patent and Trademark Office*